US008989422B2

(12) United States Patent
Tanaka et al.

(10) Patent No.: US 8,989,422 B2
(45) Date of Patent: Mar. 24, 2015

(54) MICROPHONE UNIT AND VOICE INPUT DEVICE COMPRISING SAME

(75) Inventors: Fuminori Tanaka, Daito (JP); Ryusuke Horibe, Daito (JP); Shuji Umeda, Daito (JP); Takeshi Inoda, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 11 days.

(21) Appl. No.: 13/575,004

(22) PCT Filed: Jan. 17, 2011

(86) PCT No.: PCT/JP2011/050631

§ 371 (c)(1),
(2), (4) Date: Jul. 25, 2012

(87) PCT Pub. No.: WO2011/093157

PCT Pub. Date: Aug. 4, 2011

(65) Prior Publication Data

US 2012/0300969 A1 Nov. 29, 2012

(30) Foreign Application Priority Data

Jan. 27, 2010 (JP) ..... 2010-015199

(51) Int. Cl.
*H04R 9/08* (2006.01)
*H04R 19/00* (2006.01)
(Continued)

(52) U.S. Cl.
CPC ..... *H04R 19/005* (2013.01); *H04R 19/04* (2013.01); *H04R 31/00* (2013.01); *H04R 1/342* (2013.01); *H04R 19/016* (2013.01)
USPC ..... 381/355; 381/369; 381/175

(58) Field of Classification Search
USPC ..... 381/369, 355, 375, 175
See application file for complete search history.

(56) References Cited

U.S. PATENT DOCUMENTS 3,875,349 A * 4/1975 Ruegg ..... 381/313
3,995,124 A * 11/1976 Gabr ..... 381/357
(Continued)

FOREIGN PATENT DOCUMENTS

JP S4888803 11/1973
JP 06-165286 A 6/1994
(Continued)

OTHER PUBLICATIONS

International Search Report, prepared by Japanese Patent Office, dated Mar. 1, 2011.
(Continued)

*Primary Examiner* — Davetta W Goins
*Assistant Examiner* — Amir Etesam
(74) *Attorney, Agent, or Firm* — Amster, Rothstein & Ebenstein

(57) ABSTRACT

A microphone unit (1) comprises a first vibrating part (14), a second vibrating part (15), and a housing (20) for accommodating the first vibrating part (14) and the second vibrating part (15), the housing being provided with a first sound hole (132), a second sound hole (101), and a third sound hole (133). The housing (20) is provided with a first sound path (41) for transmitting sound pressure inputted from the first sound hole (132) to one surface (142*a*) of a first diaphragm (142) and to one surface (152*a*) of a second diaphragm (152), a second sound path (42) for transmitting sound pressure inputted from the second sound hole (101) to the other surface (142*b*) of the first diaphragm (142), and a third sound path (43) for transmitting sound pressure inputted from the third sound hole (133) to the other surface (152*b*) of the second diaphragm (152).

17 Claims, 11 Drawing Sheets

(51) Int. Cl.

| | |
|---|---|
| ***H04R 19/04*** | (2006.01) |
| ***H04R 31/00*** | (2006.01) |
| *H04R 1/34* | (2006.01) |
| *H04R 19/01* | (2006.01) |

(56) References Cited

U.S. PATENT DOCUMENTS

| | | | | |
|---|---|---|---|---|
| 6,075,869 | A * | 6/2000 | Killion et al. | 381/313 |
| 6,151,399 | A | 11/2000 | Killion et al. | |
| 2004/0081327 | A1 | 4/2004 | Jensen | |
| 2004/0184632 | A1 | 9/2004 | Minervini | |
| 2008/0247586 | A1 | 10/2008 | Takano et al. | |
| 2010/0260346 | A1 | 10/2010 | Takano et al. | |

FOREIGN PATENT DOCUMENTS

| | | | |
|---|---|---|---|
| JP | 07-240990 | A | 9/1995 |
| JP | 11-243597 | A | 7/1999 |
| JP | 3279040 | B2 | 4/2002 |
| JP | 2002-171590 | A | 6/2002 |
| JP | 2002537743 | A | 11/2002 |
| JP | 2004527177 | A | 9/2004 |
| JP | 2005-295278 | A | 10/2005 |
| JP | 2007-104556 | A | 4/2007 |
| JP | 2008-258904 | A | 10/2008 |
| JP | 2008-539657 | A | 11/2008 |
| JP | 2009-130391 | A | 6/2009 |

OTHER PUBLICATIONS

Japanese Patent Office, Apr. 1, 2014 Office Action in Japanese Application No. 2010-015199.

* cited by examiner

MICROPHONE UNIT AND VOICE INPUT DEVICE COMPRISING SAME

CROSS-REFERENCE TO RELATED APPLICATIONS

This application is a U.S. national stage entry under 35 U.S.C. §371 of PCT International Application No. PCT/JP2011/050631, filed on Jan. 17, 2011, and claims priority to Japanese Application No. JP 2010-015199, filed on Jan. 27, 2010, the contents of which are incorporated herein by reference in their entirety.

TECHNICAL FIELD

The present invention relates to a microphone unit comprising a function for converting inputted sounds to electrical signals and outputting the electrical signals. The present invention also relates to a voice input device comprising such a microphone unit.

BACKGROUND ART

In conventional practice, microphone units comprising a function for converting inputted sounds to electrical signals and outputting the signals have been applied to various types of voice input devices (for example, see Patent Literature 1, 2, etc.). A voice input device is a device for converting inputted voices to electrical signals and processing the signals, and examples thereof include mobile telephones, transceivers, and other voice communication devices; voice recognition systems and other information processing systems that use techniques for analyzing inputted voices; audio recording devices; and the like.

In Patent Literature 2, for example, the applicants have disclosed a microphone unit that has a function for suppressing background noise and picking up only proximal sounds and that is suitable for a close-talking voice input device (e.g., a mobile telephone or the like). The microphone unit of Patent Literature 2 is configured as a bidirectional differential microphone unit, thereby achieving the function of suppressing background noise and picking up only proximal sounds.

LIST OF CITATIONS

Patent Literature

Patent Literature 1: Japanese Patent No. 3279040
Patent Literature 2: Japanese Laid-open Patent Application No. 2008-258904

SUMMARY OF INVENTION

Technical Problem

When a bidirectional microphone such as the one disclosed in Patent Literature 2 is installed in a mobile telephone, for example, the direction of satisfactory microphone sensitivity is limited, and there is therefore a limit on where the microphone unit is disposed in the mobile telephone. Such limits compress the configurational degree of freedom in the manufacture of a mobile telephone or another voice input device, and it is therefore desirable that such limits be reduced as much as possible.

In recent years, voice input devices have often been formed so as to be multifunctional. For example, among mobile telephones, one example of a voice input device, there are those provided with a function (hands-free function) for making a call while driving an automobile without holding the telephone in hand, in addition to the function for simply making a call with the telephone in hand. There are also recent mobile telephones provided with a function for recording video.

When making a call with the mobile telephone in hand, the user uses the telephone with their mouth near a microphone portion. Therefore, there is demand for the microphone unit provided to the mobile telephone to have a function for suppressing background noise and picking up only proximal sounds (a function as a close-talking microphone). When the hands-free function is used, there is demand for the microphone unit to be capable of widely picking up sounds from a forward direction. When video is recorded, there is demand for good forward-directional sensitivity so that voices from the direction of the recorded subject can be picked up.

To adapt to such situations, one considered possibility is to prepare a plurality of microphone units (microphone packages) having different characteristics and to install these units in a voice input device. However, in this case, a need arises to increase the surface area of the mounting substrate on which the microphone unit is mounted in the voice input device. In recent years, it has become a common requirement for mobile telephones and other voice input devices to be compact, and it is not desirable to adapt as described above to the need to enlarge the surface area of the mounting substrate on which the microphone unit is mounted. Specifically, there is demand for a compact microphone unit which is readily adapted to imparting multifunctional capability to a voice input device as a single microphone unit.

In view of the matters described above, an object of the present invention is to provide a high-performance microphone unit which is readily adapted to the diversity (e.g., diversity in terms of design and diversity in terms of function) of a voice input device. Another object of the present invention is to provide a high-quality voice input device comprising such a microphone unit.

Solution to the Problem

To achieve the objects described above, a microphone unit of the present invention comprises a first vibrating part for converting a sound signal to an electrical signal on the basis of vibration of a first diaphragm, a second vibrating part for converting a sound signal to an electrical signal on the basis of vibration of a second diaphragm, and a housing for accommodating the first vibrating part and the second vibrating part, the housing being provided with a first sound hole, a second sound hole, and a third sound hole; and the housing is provided with a first sound path for transmitting sound pressure inputted from the first sound hole to one surface of the first diaphragm and to one surface of the second diaphragm, a second sound path for transmitting sound pressure inputted from the second sound hole to the other surface of the first diaphragm, and a third sound path for transmitting sound pressure inputted from the third sound hole to the other surface of the second diaphragm.

According to the present configuration, a small microphone unit can be achieved which comprises two bidirectional differential microphones having mutually different primary axial directions of directivity (the axial directions at which sensitivity is the highest). Such a microphone unit can function as a bidirectional microphone whose primary axial direction of directivity can be controlled, due to signals outputted from two differential microphones being combined and subjected to computation processing. Therefore, the microphone unit of the present configuration has less restriction on its incorporated position when it is incorporated into a voice input device, and the microphone unit is readily adapted to the diversity of the voice input device. Since the microphone unit of the present configuration is configured comprising the bidirectional differential microphones, the microphone unit has excellent distant noise (background noise) suppression performance.

According to the microphone unit of the present configuration, as is described hereinafter, it is possible to provide a microphone unit comprising both a function as a bidirectional differential microphone having excellent distant noise suppression performance and a function as a unidirectional microphone having excellent sensitivity in the front surface direction, due to the use of an acoustic resistance member.

In the microphone unit of the configuration described above, the first sound hole and the third sound hole are formed in the same surface of the housing, and the second sound hole is formed in an opposing surface that opposes the surface in which the first sound hole and the third sound hole of the housing are formed. According to the present configuration, the two bidirectional differential microphones provided to the microphone unit can have a relationship of different primary axial directions of directivity (a relationship in which they are offset by 90°, for example).

The microphone unit of the configuration described above may be designed such that the housing comprises an installation part for installing the first vibrating part and the second vibrating part, and a cover for forming, together with the installation part, an accommodating space for accommodating the first vibrating part and the second vibrating part, the cover being placed over the installation part; there are formed in the installation part a first open part, a second open part, a hollow space for communicating the first open part and the second open part, and a sound hole constituting the second sound hole passing through from an installation surface on which the first vibrating part and the second vibrating part are installed to a rear surface thereof; there are formed in the cover the first sound hole, the third sound hole, and a concave space communicating with the first sound hole and forming the accommodating space; the first vibrating part is disposed in the installation part so as to obscure the second sound hole; the second vibrating part is disposed in the installation part so as to obscure the first open part; the first sound path is formed using the first sound hole and the accommodating space; the second sound path is formed using the second sound hole; and the third sound path is formed using the third sound hole, the second open part, the hollow space, and the first open part.

According to the present configuration, in a microphone unit readily adapted to the diversity of a voice input device, a configuration in which the housing is composed of numerous components can be avoided, and the microphone unit is easily made smaller and thinner.

The microphone unit of the configuration described above may be configured so that the installation part comprises a base provided with a groove part and a base open part, and a microphone substrate stacked on the base, the first vibrating part and the second vibrating part being mounted on the opposite surface of the surface that faces the base; wherein there are formed in the microphone substrate a first substrate open part constituting the first open part, a second substrate open part constituting the second open part, and a third substrate open part which together with the base open part forms the second sound hole; and the hollow space is formed using the groove part and the surface of the microphone substrate that opposes the base. By a configuration of the installation part according to the present configuration, the hollow space in the installation part can be readily formed.

The microphone unit of the configuration described above may further comprise an electrical circuit part for processing electrical signals obtained from the first vibrating part and the second vibrating part, the electrical circuit part being accommodated within the housing.

In the microphone unit of the configuration described above, the electrical circuit part is preferably disposed so as to be present between the first vibrating part and the second vibrating part. According to the present configuration, both of the two vibrating parts can be disposed in close proximity to the electrical circuit part. Therefore, according to the microphone unit of the present configuration, the effects of electromagnetic noise are suppressed and a satisfactory signal to noise ratio (SNR) is easily ensured.

In the microphone unit of the configuration described above, the electrical circuit part preferably separately outputs signals corresponding to the first vibrating part and signals corresponding to the second vibrating part. With a configuration in which both signals are outputted separately as in the present configuration, computation processing using both signals can be performed and the primary axial direction of directivity can be controlled in the voice input device in which the microphone unit is applied.

In the microphone unit of the configuration described above, an acoustic resistance member may be disposed so as to block the second sound hole. According to the present configuration, a microphone unit can be provided which comprises both a function as a bidirectional differential microphone having excellent distant noise suppression performance and a function as a unidirectional microphone having excellent sensitivity in the front surface direction, as described above. Therefore, the microphone unit is readily adapted to the diversity (multifunctionality) of the voice input device (a mobile telephone or the like, for example) to which the microphone unit is applied. To give a specific example, a method of use is possible in which the function as a bidirectional differential microphone is used in the close-talking mode of the mobile telephone, and the function as a unidirectional microphone is used in the hands-free mode or video record mode, for example. Since the microphone unit of the present configuration comprises both these two functions, there is no need to separately install two microphone units, and a size increase of the voice input device is readily suppressed.

In the microphone unit configured having the above-described acoustic resistance member, the first sound hole and the third sound hole may be formed in the same surface of the housing, and the second sound hole may be formed in a surface of the housing that is opposite to the surface in which the first sound hole and the third sound hole of the housing are formed.

The microphone unit configured having the above-described acoustic resistance member may be designed such that the housing comprises an installation part for installing the first vibrating part and the second vibrating part, and a cover for forming, together with the installation part, an accommodating space for accommodating the first vibrating part and the second vibrating part, the cover being placed over the installation part; there are formed in the installation part a first open part, a second open part, a hollow space for communicating the first open part and the second open part, and a sound hole constituting the second sound hole passing through from an installation surface on which the first vibrating part and the second vibrating part are installed to the rear surface thereof; there are formed in the cover the first sound hole, the third sound hole, and a concave space communicating with the first sound hole and forming the accommodating space; the first vibrating part is disposed in the installation part so as to obscure the second sound hole; the second vibrating part is disposed in the installation part so as to obscure the first open part; the first sound path is formed using the first sound hole and the accommodating space; the second sound path is formed using the second sound hole; and the third sound path is formed using the third sound hole, the second open part, the hollow space, and the first open part.

The microphone unit configured having the above-described acoustic resistance member may be designed such that the installation part comprises a base provided with a groove part and a base open part, and a microphone substrate stacked on the base, the first vibrating part and the second vibrating part being mounted on a surface of the microphone substrate that is opposite the surface that faces the base; wherein there are formed in the microphone substrate a first substrate open part constituting the first open part, a second substrate open part constituting the second open part, and a third substrate open part which together with the base open part forms the second sound hole; and the hollow space is formed using the groove part and the surface of the microphone substrate that opposes the base.

The microphone unit configured having the above-described acoustic resistance member may further comprise an electrical circuit part for processing electrical signals obtained from the first vibrating part and the second vibrating part, the electrical circuit part being accommodated within the housing.

The microphone unit configured having the above-described acoustic resistance member may be designed such that there is provided a switching electrode for inputting a switch signal from the exterior, and the electrical circuit part includes a switch circuit for performing a switching action on the basis of the switch signal. According to the present configuration, either a signal corresponding to the first vibrating part or a signal corresponding to the second vibrating part can be selectively outputted, and both can be outputted with their outputting positions switched.

The microphone unit configured having the above-described acoustic resistance member may be designed such that the switch circuit performs the switching action based on the switch signal so as to output to the exterior either the signal corresponding to the first vibrating part or the signal corresponding to the second vibrating part. According to the present configuration, a switch circuit for selecting which of the two signals to use need not be provided to the voice input device to which the microphone unit is applied.

The microphone unit configured having the above-described acoustic resistance member may be designed such that the electrical circuit part separately outputs a signal corresponding to the first vibrating part and a signal corresponding to the second vibrating part. When a configuration is used in which the two signals are outputted separately as in the present configuration, switching control of the directional characteristics can be performed in the voice input device to which the microphone unit is applied.

To achieve the objects described above, the present invention is characterized in being a voice input device comprising the microphone unit of the configuration described above.

According to the present configuration, since the configuration comprises a microphone unit that is readily adapted to the diversity of the voice input device, there is a higher degree of freedom in the design (configuration) of the voice input device, and a high-quality voice input device is easily provided.

In the voice input device of the configuration described above, the microphone unit may be provided so as to separately output signals corresponding to the first vibrating part and signals corresponding to the second vibrating part, and the voice input device may further comprise a voice signal processor for combining and performing computation processing on signals corresponding to the first vibrating part and signals corresponding to the second vibrating part, which are outputted from the microphone unit. It is thereby possible to provide a voice input device which controls the primary axial direction of directivity of a close-talking microphone having the effect of suppressing background noise so as to face a close-talking speaker, for example. Specifically, it is possible to provide a voice input device which can with good sensitivity acquire the voice of the speaker.

Advantageous Effects of the Invention

As described above, according to the present invention, a high-performance and compact microphone unit can be provided which is readily adapted to the diversity (e.g., the diversity of the design or the diversity of functions) of a voice input device. Also according to the present invention, a high-quality voice input device can be provided which comprises such a microphone unit.

DESCRIPTION OF EMBODIMENTS

Embodiments of the microphone unit and a voice input device to which the present invention is applied are described hereinbelow in detail with reference to the drawings.

First Embodiment

First, the first embodiment of the microphone unit and the voice input device to which the present invention is applied will be described.

(Microphone Unit of First Embodiment)

Figure 1:
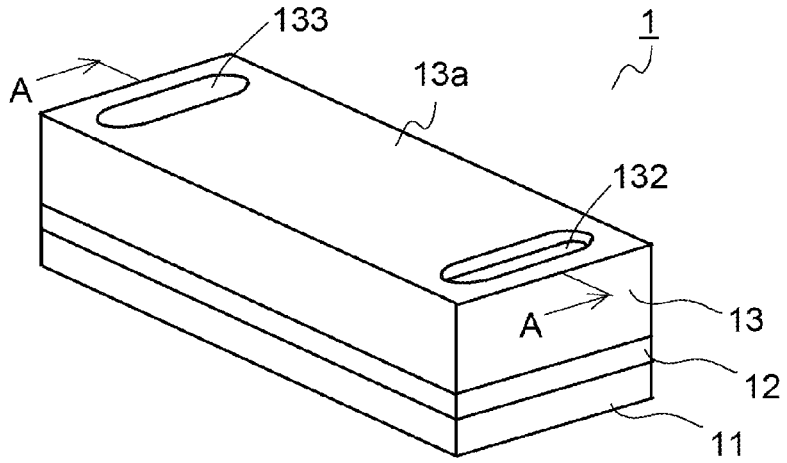
FIG. 1 A schematic perspective view showing the outer configuration of the microphone unit of the first embodiment.
Figure 2:
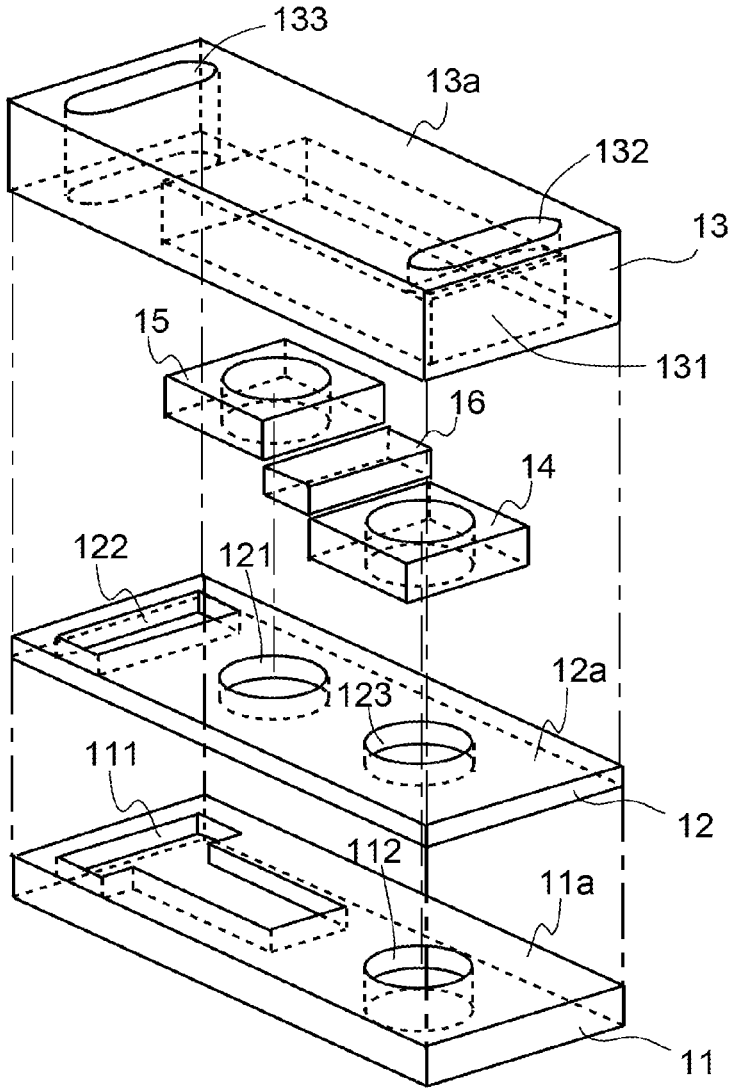
FIG. 2 An exploded perspective view showing the configuration of the microphone unit of the first embodiment.
Figure 3A:
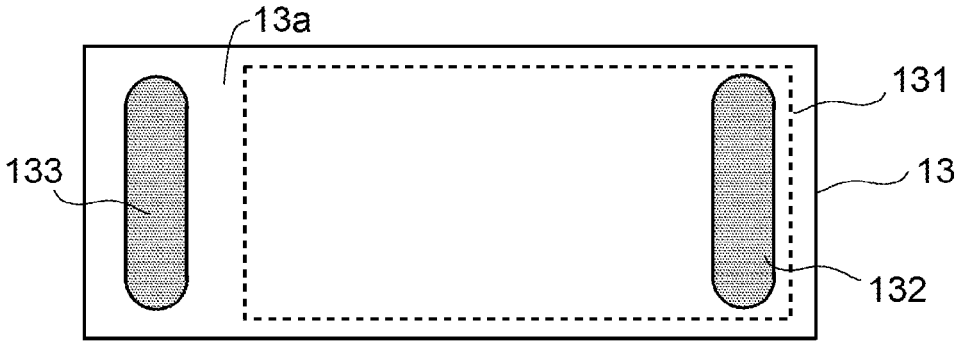
FIG. 3A A schematic plan view of a cover constituting the microphone unit of the first embodiment as seen from above.
Figure 3B:
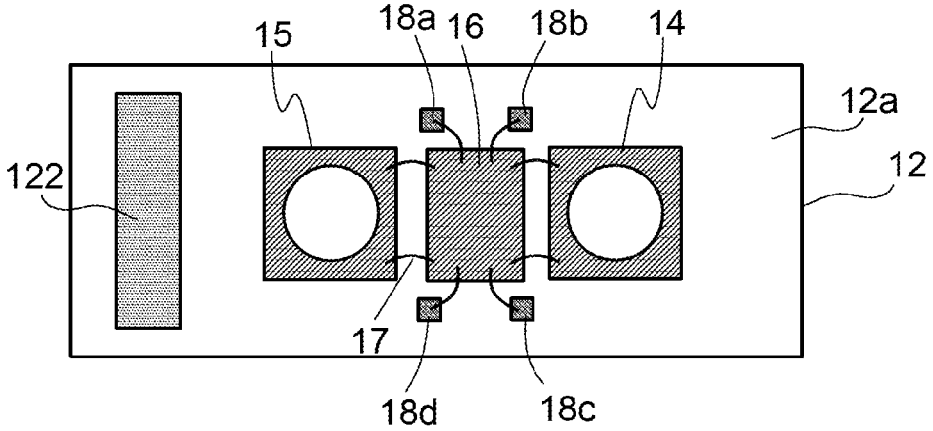
FIG. 3B A schematic plan view of a microphone substrate constituting the microphone unit of the first embodiment as seen from above, on which MEMS chips and an ASIC are installed.
Figure 3C:
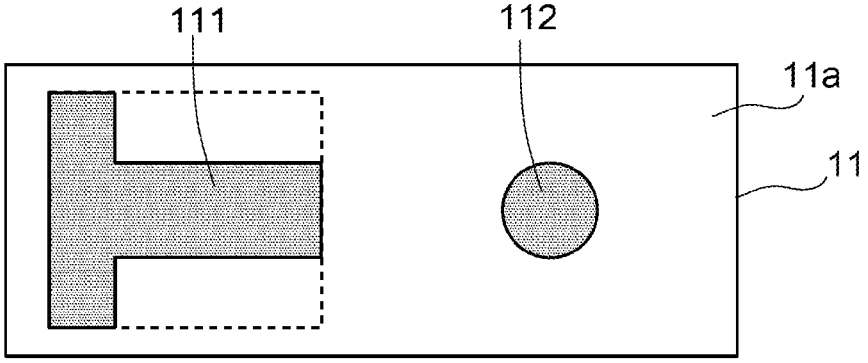
FIG. 3C A schematic plan view of a base constituting the microphone unit of the first embodiment as seen from above.
Figure 4:
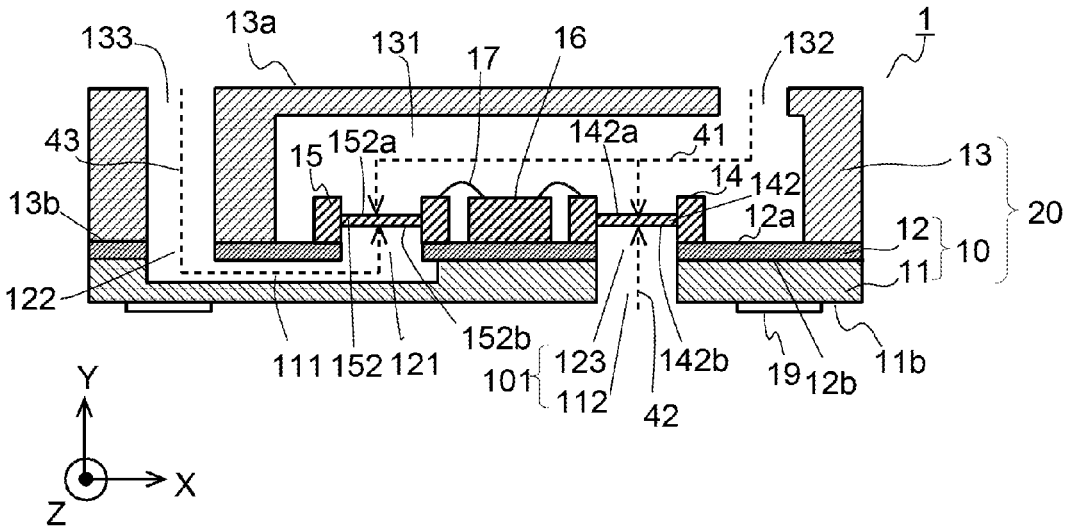
FIG. 4 A schematic cross-sectional view in the position A-A of FIG. 1.
Figure 5:
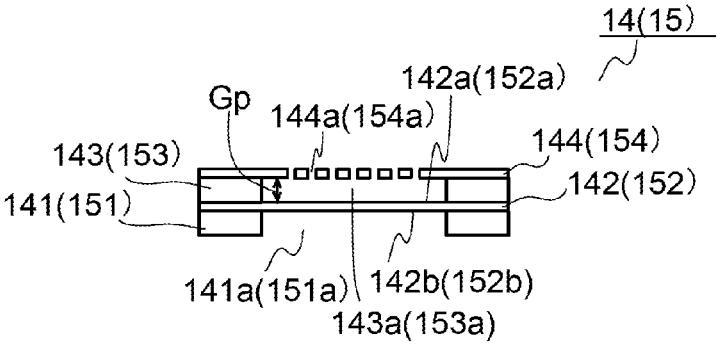
FIG. 5 A schematic cross-sectional view showing the configuration of a MEMS chip provided to the microphone unit of the first embodiment.
Figure 6:
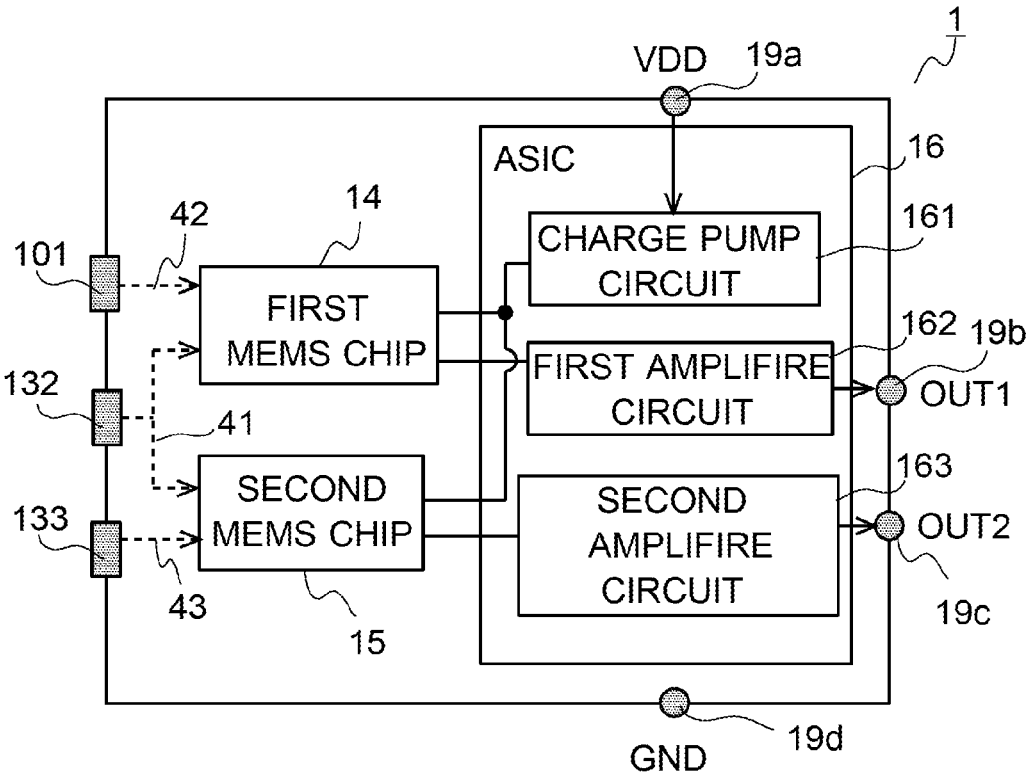
FIG. 6 A block diagram showing the configuration of the microphone unit of the first embodiment.

FIG. 1 is a schematic perspective view showing the outer configuration of the microphone unit of the first embodiment. FIG. 2 is an exploded perspective view showing the configuration of the microphone unit of the first embodiment. FIG. 3A is a schematic plan view of a cover constituting the microphone unit of the first embodiment as seen from above. FIG. 3B is a schematic plan view of a microphone substrate on which are installed a micro-electro-mechanical system (MEMS) chip and an application-specific integrated circuit (ASIC) constituting the microphone unit of the first embodiment as seen from above. FIG. 3C is a schematic plan view of a base constituting the microphone unit of the first embodiment as seen from above. FIG. 4 is a schematic cross-sectional view in the position A-A of FIG. 1. FIG. 5 is a schematic cross-sectional view showing the configuration of the MEMS chip provided to the microphone unit of the first embodiment. FIG. 6 is a block diagram showing the configuration of the microphone unit of the first embodiment. The configuration of a microphone unit 1 of the first embodiment shall be described with reference to these drawings.

The microphone unit 1 of the first embodiment as shown in FIGS. 1 through 4 has in general a configuration comprising a base 11, a microphone substrate 12 stacked on the base 11, and a cover 13 placed over the top surface 12*a* (the surface opposite the surface facing the base 11) side of the microphone substrate 12.

The base 11 is composed of a plate-shaped member having a substantially rectangular shape in plan view as shown in FIGS. 2 and 3C, for example. A groove part 111 having a substantial T shape in plan view is formed near one end in the longitudinal direction of the base 11, in the top surface 11*a* side thereof. A base open part 112 composed of a through hole having a substantially circular shape in plan view is formed in a position offset from the middle of the base 11 toward the other end in the longitudinal direction. The base 11 may be formed using FR-4, a BT resin, or another glass epoxy-based substrate material, for example, and may be obtained by resin molding using a liquid crystal polymer (LCP), polyphenylene sulfide (PPS), or another resin, for example. In cases in which the base 11 is formed from FR-4 or another substrate material, the groove part 111 and the base open part 112 are preferably formed by mechanical working using a router or drill, for example.

The base 11 may be formed in two layers, one layer being formed as a substrate in which only a hole constituting the base open part 112 is formed, the other layer being formed as a substrate in which holes constituting the base open part 112 and the groove part 111 are formed, and the base 11 being configured by attaching the two layers together. In this case, since both layers are configured having through holes, the holes can be formed by hole perforation working by punching, and manufacturing efficiency can be greatly improved.

The microphone substrate 12 is formed into a substantially rectangular shape in plan view as shown in FIGS. 2 and 3B, for example, and the size of the plate-shaped surface thereof (the top surface 12*a*) is substantially the same as the size of the plate-shaped surface (the top surface 11*a*) of the base 11. Three substrate open parts 121, 122, 123 aligned in the longitudinal direction are formed in the microphone substrate 12 by mechanical working, for example, as shown in FIG. 2.

The first substrate open part 121, which is formed in a position offset from the middle of the microphone substrate 12 toward one end in the longitudinal direction (toward the left in FIG. 3B), is composed of a through hole having a substantially circular shape in plan view. When the microphone substrate 12 is stacked on the base 11, the position of the first substrate open part 121 is set so as to overlap part of the groove part 111 formed in the base 11 (to be more accurate, a part of the portion that extends parallel to the longitudinal direction of the base 11). The second substrate open part 122, which is formed near one end of the microphone substrate 12 in the longitudinal direction (the left end in FIG. 3B), is composed of a through-hole having a substantially rectangular shape in plan view, whose longitudinal direction is the transverse direction of the microphone substrate 12 (the up-down direction in FIG. 3B). The position of the second substrate open part 122 is set so as to overlap with the transverse direction-extending portion of the groove part 111 formed in the base 11. The third substrate open part 123, which is formed in a position offset from the middle of the microphone substrate 12 toward the other end in the longitudinal direction (the right end in FIG. 3B), is composed of a through hole having a substantially circular shape in plan view. The position of this third substrate open part 123 is set so as to overlap with the base open part 112 formed in the base 11 when the microphone substrate 12 is stacked on the base 11.

The material constituting the microphone substrate 12 is not particularly limited, but a conventionally known material is preferably used as the substrate material, e.g., FR-4, a ceramic, a polyimide film, or the like is used.

Installed on the top surface 12*a* of the microphone substrate 12 are a first MEMS chip 14, a second MEMS chip 15, and an ASIC 16, as shown in FIGS. 3B and 4. The configurations of the MEMS chips 14, 15 and the ASIC 16 installed on the microphone substrate 12 are described herein.

The first MEMS chip 14 and the second MEMS chip 15 are both composed of silicon chips and both have the same configuration. Therefore, the configuration of the MEMS chips is described using the first MEMS chip 14 as an example. In FIG. 5, the symbols in parentheses are symbols corresponding to the second MEMS chip 15.

The first MEMS chip 14 is configured by stacking an insulating first base substrate 141, a first diaphragm 142, a first insulating layer 143, and a first fixed electrode 144, as shown in FIG. 5. An opening 141*a* having a substantially circular shape in plan view is formed in the first base substrate 141. The first diaphragm 142 provided on top of the first base substrate 141 is a thin film which vibrates in response to sound pressure (vibrates in the up-down direction in FIG. 5), and is electrically conductive.

The first insulating layer 143 is provided so as to be disposed creating a gap Gp between the first diaphragm 142 and the first fixed electrode 144, and a through-hole 143*a* having a substantially circular shape in plan view is formed in the middle thereof. The first fixed electrode 144 disposed on top of the first insulating layer 143 is disposed facing the first diaphragm 142 while being substantially parallel to the first diaphragm 142, and capacitor capacitance is formed between the first diaphragm 142 and the first fixed electrode 144. A plurality of through-holes 144*a* are formed in the first fixed electrode 144 so that acoustic waves can pass through, and acoustic waves coming from the top side of the first diaphragm 142 reach the top surface 142*a* of the first diaphragm 142.

Thus, in the first MEMS chip 14 configured as a capacitor-type microphone, when the first diaphragm 142 is made to vibrate by the arrival of acoustic waves, the electrostatic capacitance between the first diaphragm 142 and the first fixed electrode 144 changes. As a result, the acoustic waves (acoustic signals) incident on the first MEMS chip 14 are extracted as electrical signals. Similarly, the second MEMS chip 15 comprises a second base substrate 151, a second diaphragm 152, a second insulating layer 153, and a second fixed electrode 154, and acoustic waves (acoustic signals) incident on the second MEMS chip 15 are extracted as electrical signals as well. Specifically, the first MEMS chip 14 and the second MEMS chip 15 have the function of converting acoustic signals to electrical signals.

The configuration of the MEMS chips 14, 15 is not limited to the configuration of the present embodiment. For example, in the present embodiment, the diaphragms 142, 152 are lower than the fixed electrodes 144, 154, but a configuration in which the relationship is reversed (a relationship in which the diaphragms are above and the fixed electrodes are below) may also be used.

The ASIC 16 is an integrated circuit for amplifying electrical signals extracted based on the changes in electrostatic capacitance of the first MEMS chip 14 (originating in the vibration of the first diaphragm 142), and electrical signals extracted based on the changes in electrostatic capacitance of the second MEMS chip 15 (originating in the vibration of the second diaphragm 152).

The ASIC 16 comprises a charge pump circuit 161 for applying bypass voltage to the first MEMS chip 14 and the second MEMS chip 15, as shown in FIG. 6. The charge pump circuit 161 increases a power source voltage (from about 1.5 to 3 V, to about 6 to 10 V, for example) and applies the bypass voltage to the first MEMS chip 14 and the second MEMS chip 15. The ASIC 16 also comprises a first amplifier circuit 162 for detecting changes in electrostatic capacitance in the first MEMS chip 14, and a second amplifier circuit 163 for detecting changes in electrostatic capacitance in the second MEMS chip 15. The electrical signals amplified by the first amplifier circuit 162 and the second amplifier circuit 163 are outputted independently from the ASIC 16.

The charge pump circuit 161 has a configuration in which a shared bypass voltage is applied to the first MEMS chip 14 and the second MEMS chip 15. Commonly a large capacitor capacitance is required in order to configure the charge pump circuit 161, and a large semiconductor chip surface area is consumed. By having a bypass shared between the first MEMS chip 14 and the second MEMS chip 15 and supplying the bypass from a single charge pump power source, the semiconductor chip surface area is reduced and the size of the ASIC 16 is reduced. As a result, it is possible to make the microphone unit 1 compact in size.

The present embodiment has a configuration in which a shared bypass voltage is applied to the first MEMS chip 14 and the second MEMS chip 15, but the present embodiment is not limited to this configuration. For example, two charge pump circuits 161 may be provided and may apply bypass voltages separately to the first MEMS chip 14 and the second MEMS chip 15. With such a configuration, the possibility of crosstalk occurring between the first MEMS chip 14 and the second MEMS chip 15 can be reduced.

In the microphone unit 1, the two MEMS chips 14, 15 are installed on the microphone substrate 12 with the diaphragms 142, 152 in an orientation of being nearly parallel to the top surface 12*a* of the microphone substrate 12, as shown in FIG. 4. In the microphone unit 1, the MEMS chips 14, 15 and the ASIC 16 are installed so as to be aligned in a row in the longitudinal direction of the top surface 12*a* of the microphone substrate 12 (the left-right direction in FIGS. 3B and 4). The alignment order is, starting from the right referring to FIGS. 3B and 4, the first MEMS chip 14, the ASIC 16, and the second MEMS chip 15.

The first MEMS chip 14 is installed on the top surface 12*a* of the microphone substrate 12 so that the first diaphragm 142 covers the third substrate open part 123 formed in the microphone substrate 12, as can be seen by referring to FIGS. 3B and 4. The third substrate open part 123 is obscured by the first MEMS chip 14. The second MEMS chip 15 is also installed on the top surface 12*a* of the microphone substrate 12 so that the second diaphragm 152 covers the first substrate open part 121 formed in the microphone substrate 12, as can be seen by referring to FIGS. 3B and 4. The first substrate open part 121 is obscured by the second MEMS chip 15.

In the present embodiment, the MEMS chips 14, 15 obscuring the substrate open parts 121, 123 are installed on the microphone substrate 12 so that the diaphragms 142, 152 cover the entire substrate open parts 121, 123. However, the configuration is not limited to this example, and the MEMS chips 14, 15 obscuring the substrate open parts 121, 123 may be installed on the microphone substrate 12 so that the diaphragms 142, 152 partially cover the substrate open parts 121, 123.

The two MEMS chips 14, 15 and the ASIC 16 are mounted on the microphone substrate 12 by die bonding and wire bonding. Specifically, the entire bottom surfaces of the first MEMS chip 14 and the second MEMS chip 15 that face the top surface 12*a* of the microphone substrate 12 are bonded without any gaps by a die bond material not shown (e.g., an epoxy resin-based or silicone resin-based adhesive or the like). Bonding in this manner ensures that there will be no situations in which sounds leak out from gaps formed between the top surface 12*a* of the microphone substrate 12 and the bottom surface of the MEMS chips 14, 15. The two MEMS chips 14, 15 are both electrically connected to the ASIC 16 by wires 17, as shown in FIG. 3B.

The bottom surface of the ASIC 16 that faces the top surface 12*a* of the microphone substrate 12 is bonded thereto using a die bond material not shown. The ASIC 16 is also electrically connected by the wires 17 to each of a plurality of electrode terminals 18*a*, 18*b*, 18*c*, 18*d* formed on the top surface 12*a* of the microphone substrate 12, as shown in FIG. 3B. The plurality of electrode terminals 18*a* to 18*d* formed in the microphone substrate 12 are composed of a power source terminal 18*a* for inputting power source voltage (VDD), a first output terminal 18*b* for outputting electrical signals amplified by the first amplifier circuit 162 of the ASIC 16, a second output terminal 18*c* for outputting electrical signals amplified by the second amplifier circuit 163 of the ASIC 16, and a GND terminal 18*d* for a ground connection.

Each of the plurality of electrode terminals 18*a* to 18*d* provided to the top surface 12*a* of the microphone substrate 12 is electrically connected to external connecting electrodes 19 (specifically, a power source electrode 19*a*, a first output electrode 19*b*, a second output electrode 19*c*, and a GND electrode 19*d* (see FIG. 6)) formed on the bottom surface 11*b* (see FIG. 4) of the base 11, via wiring (including through wiring) not shown formed on the microphone substrate 12 and the base 11. The external connecting electrodes 19 are used in order to connect to connection terminals formed on the mounting substrate on which the microphone unit 1 is mounted.

The above description relates to a configuration in which the two MEMS chips 14, and the ASIC 16 are mounted by wire bonding, but the configuration is not limited to this example, and the two MEMS chips 14, 15 and the ASIC 16 may also of course be flip-chip mounted.

The outer shape of the cover 13 has a substantially rectangular parallelepiped shape, and a substantially rectangular parallelepiped-shaped concave space 131 is formed therein, as shown in FIGS. 1 through 4. The concave space 131 has a configuration which extends to the proximity of one end side in the longitudinal direction of the cover 13 (the right side in FIG. 4), but does not extend to the proximity of the other end side (the left side in FIG. 4). The cover 13 is placed over the microphone substrate 12 with the concave space 131 and the microphone substrate 12 oriented facing each other so that an accommodating space for accommodating the two MEMS chips 14, 15 and the ASIC 16 is formed between the concave space 131 and the microphone substrate 12.

The lengths of the cover 13 in the longitudinal direction (the left-right direction of FIG. 3A) and the transverse direction (the up-down direction of FIG. 3A) are provided to be substantially equal to the size of the top surface 12*a* of the microphone substrate 12. Consequently, side surface parts are substantially flush in the microphone unit 1 in which the microphone substrate 12 and the cover 13 are stacked on the base 11.

In one end side in the longitudinal direction of a cover top surface 13*a* (the right side in FIG. 3A) is formed a first cover open part 132 having a substantially elliptical shape in plan view, whose major axis direction is the transverse direction of the cover 13. The first cover open part 132 is in communication with the concave space 131 of the cover 13, as shown in FIG. 4, for example. In the other end side in the longitudinal direction of the cover top surface 13*a* (the left side in FIG. 3A) is formed a second cover open part 133 having a substantially elliptical shape in plan view, whose major axis direction is the transverse direction of the cover 13. The second cover open part 133 is a through-hole passing through from the top surface 13*a* of the cover 13 to a bottom surface 13*b*, as shown in FIG. 4, for example.

The position of the second cover open part 133 is adjusted so that when the cover 13 is covering the microphone substrate 12, the second cover open part 133 is communicated with the second substrate open part 122 formed in the microphone substrate 12.

The cover 13 may be formed using the same substrate material as the microphone substrate 12: FR-4, a BT resin, or another glass epoxy-based substrate material, for example, and may be obtained by resin molding using an LCP, PPS, or another resin, for example. In cases in which the cover 13 is formed from FR-4 or another substrate material, the concave space 131, the first cover open part 132, and the second cover open part 133 are preferably formed by mechanical working using a router or drill, for example.

The cover 13 may be formed in two layers, one layer being formed as a substrate in which holes constituting the first cover open part 132 and the second cover open part 133 are formed, the other layer being formed as a substrate in which holes constituting the concave space 131 and the second cover open part 133 are formed, and the cover 13 being configured by attaching the two layers together. In this case, since both layers are configured having through holes, the holes can be formed by hole perforation working by punching, and manufacturing efficiency can be greatly improved.

The base 11, microphone substrate 12 (on which the two MEMS chips 14, 15 and the ASIC 16 are mounted), and cover 13 are stacked sequentially in the stated order from the bottom and attached using an adhesive, or the like, between the members, for example. A microphone unit 1 such as the one shown in FIG. 1 is thus obtained. In the microphone unit 1, acoustic waves inputted from the exterior via the first cover open part 132 pass through the accommodating space (the space formed between the concave space 131 of the cover 13 and the top surface 12*a* of the microphone substrate 12) and reach the top surface 142*a* of the first diaphragm 142 and the top surface 152*a* of the second diaphragm 152, as shown in FIG. 4. Acoustic waves inputted from the exterior via the base open part 112 and the third substrate open part 123 reach the bottom surface 142*b* of the first diaphragm 142. Acoustic waves inputted from the exterior via the second cover open part 133 pass through the second substrate open part 122, a hollow space (the space formed using the groove part 111 of the base 11 and a bottom surface 12*b* of the microphone substrate 12), and the first substrate open part 121, and reach the bottom surface 152*b* of the second diaphragm 152.

In other words, the microphone unit 1 is provided with a first sound path 41 for transmitting sound pressure inputted from the first cover open part 132 functioning as a first sound hole to one surface (the top surface 142*a*) of the first diaphragm 142 and also to one surface (the top surface 152*a*) of the second diaphragm 152; a second sound path 42 for transmitting sound pressure inputted from the base open part 112 and third substrate open part 123 functioning as a second sound hole to the other surface (the bottom surface 142*b*) of the first diaphragm 142; and a third sound path 43 for transmitting sound pressure inputted from the second cover open part 133 functioning as a third sound hole to the other surface (the bottom surface 152*b*) of the second diaphragm 152.

Hereinbelow, the first cover open part 132 is sometimes referred to as the first sound hole 132, and the second cover open part 133 is sometimes referred to as the third sound hole 133. The sound hole formed by the base open part 112 and the third substrate open part 123 is sometimes referred to as the second sound hole 101.

The first MEMS chip 14 is an embodiment of the first vibrating part of the present invention. The second MEMS chip 15 is an embodiment of the second vibrating part of the present invention. The ASIC 16 is an embodiment of the electrical circuit part of the present invention. The base 11, the microphone substrate 12, and the cover 13 combined together are an embodiment of the housing of the present invention. The base 11 and the microphone substrate 12 combined together are an embodiment of the installation part of the present invention. An embodiment of the hollow space of the present invention (this space communicates the first substrate open part 121 and the second substrate open part 122) is obtained using the groove part 111 of the base 11 and the bottom surface 12*b* of the microphone substrate 12.

In the microphone unit 1 of the present embodiment, the base 11, microphone substrate 12, and cover 13 constituting the housing 20 are all made of the substrate material FR-4. Thus, when the material constituting the housing 20 is all the same material, it is possible to suppress the occurrence of warping in the microphone substrate 12 caused by a difference in the expansion coefficients of the materials constituting the housing, and situations are avoided in which unnecessary stress is added to the MEMS chips 14, 15 installed on the microphone substrate 12, in cases in which the microphone unit 1 is reflow-mounted to the mount substrate. Specifically, degradation of the characteristics of the microphone unit 1 is avoided.

In the present embodiment, the base 11 constituting the installation part 10 is a flat plate, but is not limited to this shape. Specifically, the shape of the base, for example, may be a box shape or the like having an accommodating concavity for accommodating the microphone substrate 12 and the cover 13. Such a configuration makes it possible to simplify the positional alignment of the base 11, microphone substrate 12, and cover 13, and assembling the microphone unit 1 is also simplified.

In the present embodiment, the shape of the groove part 111 formed in the base 11 is a substantial T shape in plan view, but is not limited to this configuration. Specifically, the shape may be substantially rectangular in plan view (the configuration shown by the dashed lines in FIG. 3C), for example. By using a configuration such as the present embodiment, the cross-sectional area of the spaces that serve as sound paths can be ensured to a certain extent, and the surface area in which the microphone substrate 12 is supported by the base 11 can be increased. It is thereby easy to avoid situations in which bending of the microphone substrate 12 causes a decrease in the cross-sectional area of the hollow space that is formed using the bottom surface 12*b* of the microphone substrate 12 and the groove part 111 of the base 11.

In the present embodiment, the two sound holes 132, 133 formed in the cover 13 are in the shapes of long holes, but are not limited to this configuration, and may be sound holes or the like having substantially circular shapes in plan view, for example. Long hole shapes as in the present configuration are preferred because increases in the length in the longitudinal direction of the microphone unit 1 (equivalent to the left-right direction of FIG. 4) can be suppressed, and the cross-sectional area of the sound holes can be increased.

For the same reasons, the second substrate open part 122 provided to the microphone substrate 12 is also in the shape of a long hole, but this shape can also be suitably modified. In the present embodiment, the second substrate open part 122, which is a passage for acoustic waves inputted from the third sound hole 133 (the second cover open part 133), is formed by one large through-hole (the second substrate open part 122). However, the configuration is not limited to such, and a plurality of small (smaller than the size of the second substrate open part 122 of the present embodiment) through-holes aligned along the transverse direction of the microphone substrate 12 (the up-down direction of FIG. 3B) may be used as passages for acoustic waves inputted from the third sound hole 133, for example. Such a configuration makes it easy to form a through-hole provided to the microphone substrate 12 in order to ensure a passage for acoustic waves inputted from the third sound hole 133. The reason for having a plurality of through-holes is to increase the cross-sectional area of the passage. The shapes of these through-holes are not particularly limited, but the shapes can be round holes (substantially circular shapes in plan view). Round holes can be formed in a simple manner by hole perforation using a drill, and manufacturing efficiency can be improved. The individual maximum hole sizes also decrease, and the effect of preventing waste from entering is therefore also achieved.

In the present embodiment, the ASIC 16 is configured as being disposed so as to be present between the two MEMS chips 14, 15, but such a configuration is not necessarily provided by way of limitation. In the case that the ASIC 16 is configured so as to be present between the two MEMS chips 14, 15, as in the present embodiment, the MEMS chips 14, 15 and the ASIC 16 can be readily electrically connected by the wires 17. Since the distances between the MEMS chips 14, 15 and the ASIC 16 are shorter, signals outputted from the microphone unit 1 are less affected by electromagnetic noise and a satisfactory SNR is easily ensured.

Next, the operational effects of the microphone unit 1 of the first embodiment are described.

When a sound occurs in the exterior of the microphone unit 1, acoustic waves inputted from the first sound hole 132 reach the top surface 142*a* of the first diaphragm 142 by way of the first sound path 41, and acoustic waves inputted from the second sound hole 101 reach the bottom surface 142*b* of the first diaphragm 142 by way of the second sound path 42. Therefore, the first diaphragm 142 vibrates due to the difference between the sound pressure applied to the top surface 142*a* and the sound pressure applied to the bottom surface 142*b*. A change in electrostatic capacitance thereby occurs in the first MEMS chip 14. An electrical signal extracted based on the change in electrostatic capacitance of the first MEMS chip 14 is amplified by the first amplifier circuit 162 and outputted from the first output electrode 19*b* (see FIGS. 4 and 6).

When a sound occurs in the exterior of the microphone unit 1, acoustic waves inputted from the first sound hole 132 reach the top surface 152*a* of the second diaphragm 152 by way of the first sound path 41, and acoustic waves inputted from the third sound hole 133 reach the bottom surface 152*b* of the second diaphragm 152 by way of the third sound path 43. Therefore, the second diaphragm 152 vibrates due to the sound pressure difference between the sound pressure added to the top surface 152*a* and the sound pressure added to the bottom surface 152*b*. A change in electrostatic capacitance thereby occurs in the second MEMS chip 15. An electrical signal extracted based on the change in electrostatic capacitance of the second MEMS chip 15 is amplified by the second amplifier circuit 163 and outputted from the second output electrode 19*c* (see FIGS. 4 and 6).

Thus, in the microphone unit 1, signals obtained using the first MEMS chip 14 and signals obtained using the second MEMS chip 15 are outputted to the exterior separately. The first MEMS chip 14 and the second MEMS chip 15 in the microphone unit 1 both exhibit the function of a bidirectional differential microphone. The characteristics of the microphone unit 1 configured in this manner are described hereinbelow with reference to FIGS. 7 and 8.

Figure 7:
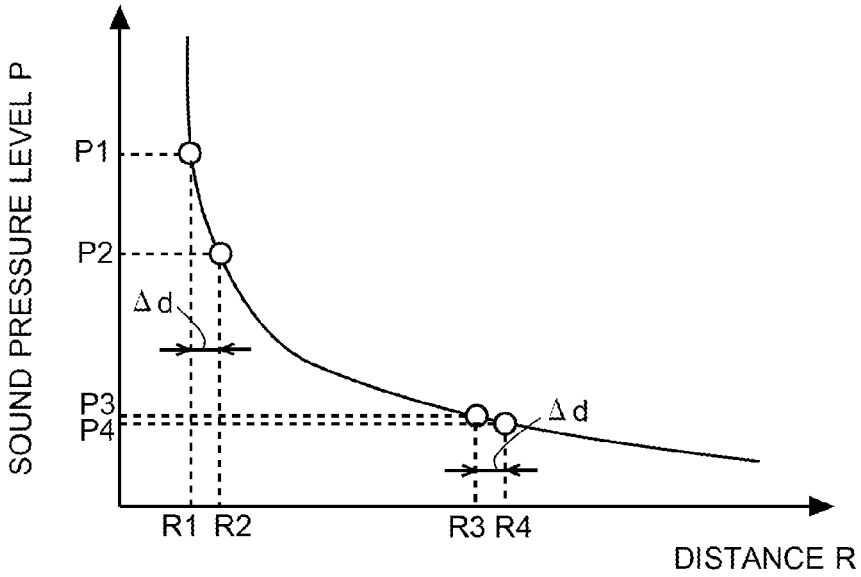
FIG. 7 A graph showing the relationship between sound pressure P and the distance R from the sound source.
Figure 8:
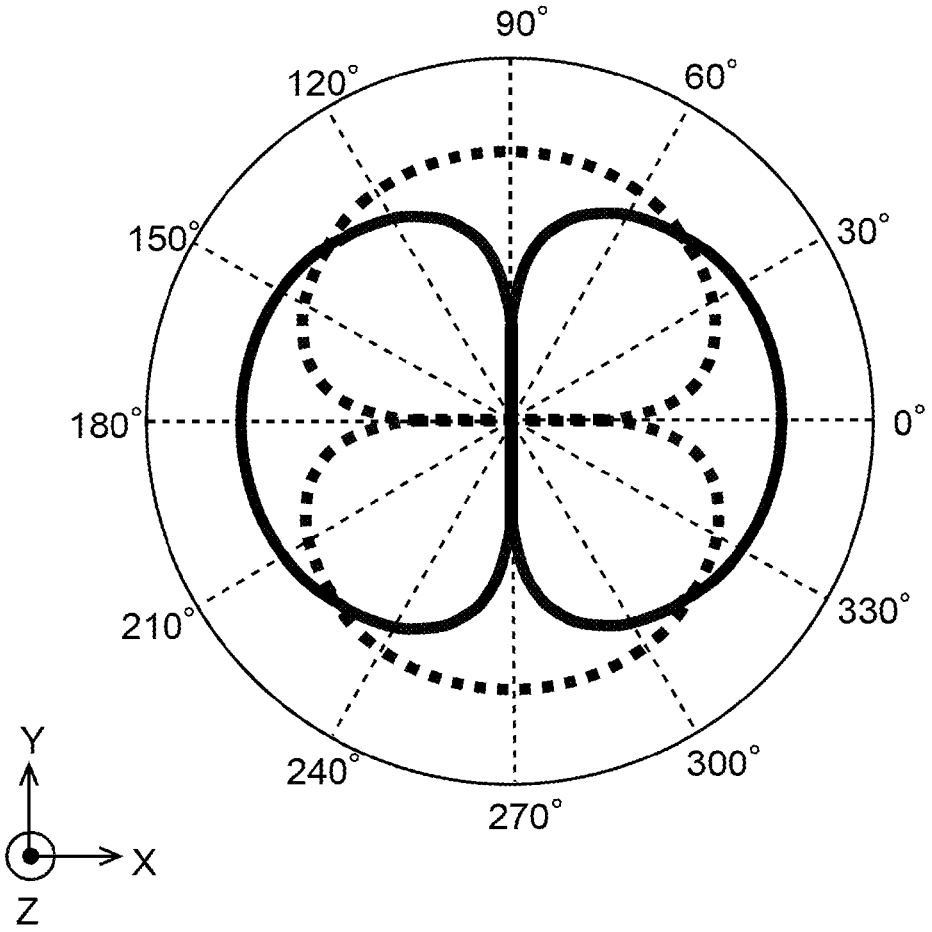
FIG. 8 A drawing for describing the directional characteristics of a differential microphone configured from a first MEMS chip, and the directional characteristics of a differential microphone configured from a second MEMS chip.

FIG. 7 is a graph showing the relationship between sound pressure P and distance R from the sound source. FIG. 8 is a drawing for describing the directional characteristics of a differential microphone configured from a first MEMS chip (dashed lines), and the directional characteristics of a differential microphone configured from a second MEMS chip (solid lines). In FIG. 8, the orientation of the microphone unit 1 is assumed to be the same as the orientation shown in FIG. 4.

Acoustic waves attenuate as they travel through air or another medium, and the sound pressure (the strength/amplitude of the acoustic waves) decreases, as shown in FIG. 7. The sound pressure is inversely proportional to the distance from the sound source, and the relationship between the sound pressure P and the distance R is expressed by the following formula (1). The letter k in formula (1) represents a proportionality constant.

$$P=k/R \quad (1)$$

As is clear from FIG. 7 and formula (1), the sound pressure rapidly attenuates at a position near the sound source (the left side of the graph), and attenuates at a slower rate the farther from the sound source (the right side of the graph). Specifically, the sound pressures transmitted to two positions whose distances from the sound source differ by an amount Δd (R1 and R2, and R3 and R4) attenuate greatly (P1-P2) from R1 to R2 whose distances from the sound source are small, but do not attenuate by much (P3-P4) from R3 to R4 whose distances from the sound source are great.

In this case, it is assumed that the distance from the sound source of the target sound to be picked up by the microphone unit 1 differs between the first sound hole 132 and the second sound hole 101. In this case, the sound pressure of the target sound generated in the proximity of the microphone unit 1 differs greatly between the top surface 142*a* and the bottom surface 142*b* of the first diaphragm 142. The sound pressure of background noise (distant noise) has virtually no difference between the top surface 142*a* and the bottom surface 142*b* of the first diaphragm 142 because the sound source is in a farther position than the target sound.

Since the sound pressure difference of the background noise received by the first diaphragm 142 is small, sound pressure of background noise is substantially negated in the first diaphragm 142. Since the sound pressure difference of the target sound received by the first diaphragm 142 is large, the sound pressure of the target sound is not negated in the first diaphragm 142. Therefore, a signal obtained by the vibration of the first diaphragm 142 is regarded as a signal of the target sound from which background noise has been removed. Therefore, a differential microphone configured from the first MEMS chip 14 has excellent distant noise suppression performance. Similarly, a differential microphone configured from the second MEMS chip 15 also has excellent distant noise suppression performance.

As described above, the differential microphone configured by the first MEMS chip 14 and the differential microphone configured by the second MEMS chip 15 both display bidirectivity, but the primary axial directions of these directivities are offset by approximately 90°, as shown in FIG. 8.

With the differential microphone configured by the first MEMS chip 14, if the distance from the sound source to the first diaphragm 142 remains constant, the sound pressure added to the first diaphragm 142 reaches a maximum when the sound source is in the 90° or 270° direction. This is because there is the greatest difference between the distance for acoustic waves to reach the top surface 142*a* of the first diaphragm 142 from the first sound hole 132, and the distance for acoustic waves to reach the bottom surface 142*b* of the first diaphragm 142 from the second sound hole 101. On the other hand, the sound pressure added to the first diaphragm 142 reaches a minimum when the sound source is in the 0° or 180° direction. This is because there is virtually no difference between the distance for acoustic waves to reach the top surface 142*a* of the first diaphragm 142 from the first sound hole 132, and the distance for acoustic waves to reach the bottom surface 142*b* of the first diaphragm 142 from the second sound hole 101. Specifically, the differential microphone configured by the first MEMS chip 14 displays the properties of readily receiving acoustic waves incident from the 90° and 270° directions and not readily receiving acoustic waves incident from the 0° and 180° directions.

With the differential microphone configured by the second MEMS chip 15, if the distance from the sound source to the second diaphragm 152 remains constant, the sound pressure added to the second diaphragm 152 reaches a maximum when the sound source is the 0° or 180° direction. This is because there is the greatest difference between the distance for acoustic waves to reach the top surface 152*a* of the second diaphragm 152 from the first sound hole 132, and the distance for acoustic waves to reach the bottom surface 152*b* of the second diaphragm 152 from the third sound hole 133. On the other hand, the sound pressure added to the second diaphragm 152 reaches a minimum when the sound source is in the 90° or 270° direction. This is because there is virtually no difference between the distance for acoustic waves to reach the top surface 152*a* of the second diaphragm 152 from the first sound hole 132, and the distance for acoustic waves to reach the bottom surface 152*b* of the second diaphragm 152 from the third sound hole 133. Specifically, the differential microphone configured by the second MEMS chip 15 displays the properties of readily receiving acoustic waves incident from the 0° and 180° directions and not readily receiving acoustic waves incident from the 90° and 270° directions.

Thus, the microphone unit 1 is configured comprising two bidirectional differential microphones having different primary axial directions of directivity. In the microphone unit 1 as described above, signals extracted from the first MEMS chip 14 and signals extracted from the second MEMS chip 15 are separately processed (amplified) and outputted to the exterior. In this case, by combining the two separately outputted signals and performing a predetermined computation process, the microphone unit 1 can be made to function as a bidirectional microphone in which the primary axial direction of directivity can be controlled. This is described with reference to FIGS. 9 and 10.

(Voice Input Device Comprising Microphone Unit of First Embodiment)

Figure 9:
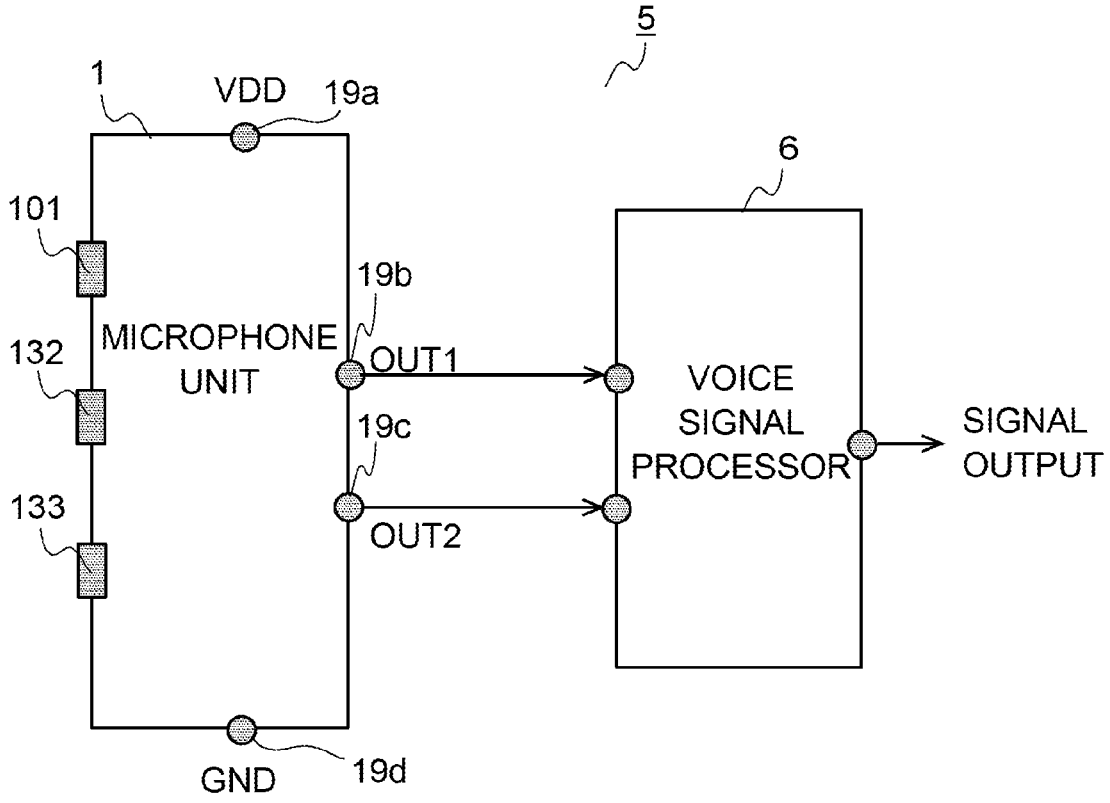
FIG. 9 A block diagram showing the configuration of a voice input device comprising the microphone unit of the first embodiment.

FIG. 9 is a block diagram showing the configuration of the voice input device comprising the microphone unit of the first embodiment. The voice input device 5 of the first embodiment comprises the microphone unit 1 and a voice signal processor 6 for combining two signals outputted from the microphone unit 1 and performing a predetermined computation process.

In the present embodiment, the voice signal processor 6 executes the computation process shown in the following formula (2), for example. In formula (2), OUT1 is a signal output corresponding to the first MEMS chip 14 (the output from the first output electrode 19*b*), and OUT2 is a signal output corresponding to the second MEMS chip 15 (the output from the second output electrode 19*c*). In formula (2), k is a variable for weighting.

$$(1-|k|)\times \mathrm{OUT2}-ks\times \mathrm{OUT1} \quad (2)$$

Figure 10:
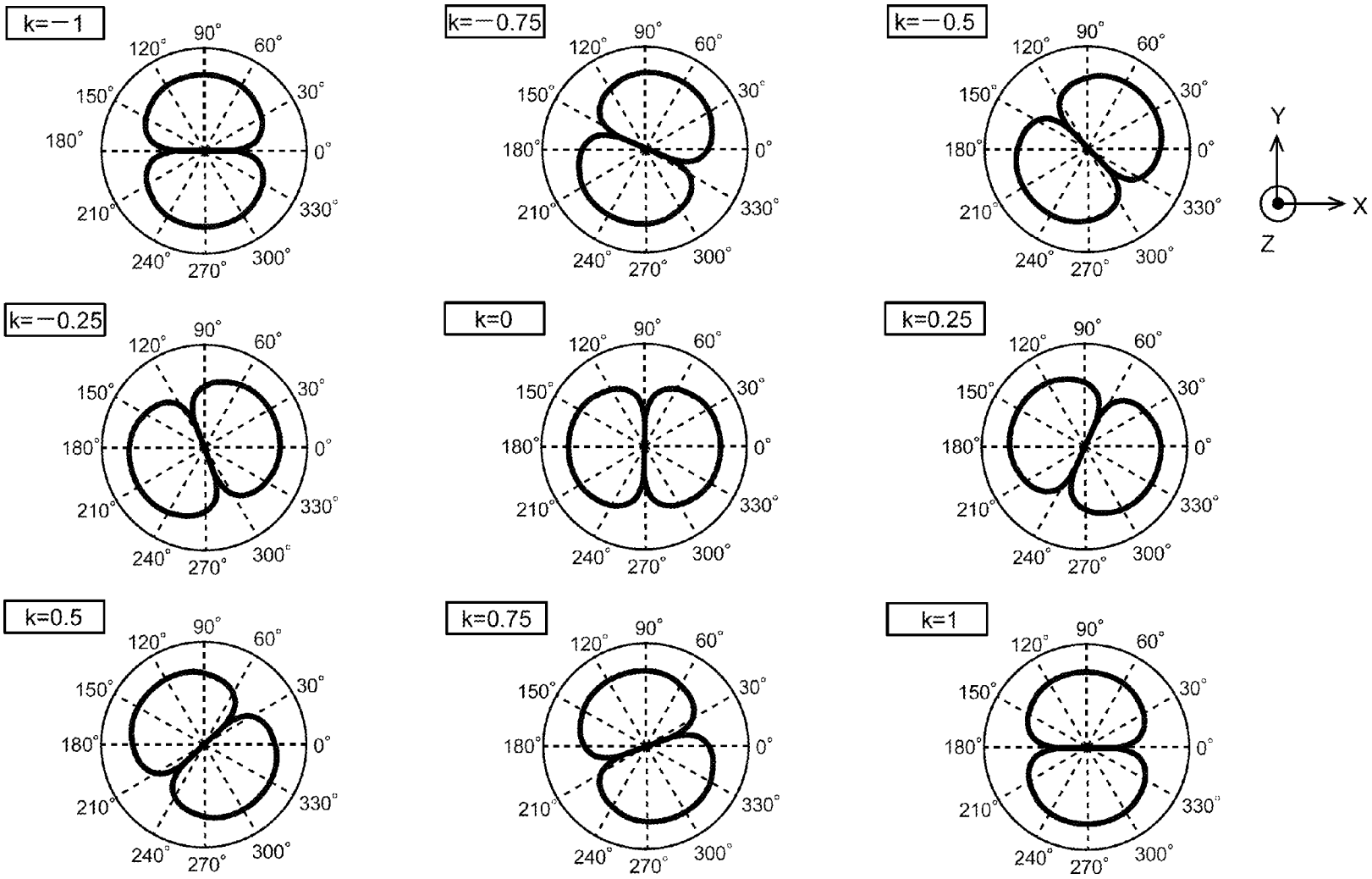
FIG. 10 A drawing showing the manner in which varying the variable (k) of the computation process performed by the voice signal processor causes fluctuation of the primary axial direction of directivity of the microphone unit functioning as a bidirectional microphone.

FIG. 10 is a drawing showing the manner in which varying the variable (k) of the computation process performed by the voice signal processor causes fluctuation of the primary axial direction of directivity of the microphone unit functioning as a bidirectional microphone. As shown in FIG. 10, the primary axial direction of the microphone unit 1 is capable of being rotatably controlled in a direction encircling the Z axis, which is orthogonal to the X direction which is the longitudinal direction of the microphone unit 1 and the Y direction which is the thickness direction of the microphone unit 1, by the selection of the value of k in formula (2).

When k=−1 or when k=1, for example, the primary axial direction of directivity of the microphone unit 1 is parallel to the Y direction which is the thickness direction of the microphone unit 1, and when k=0, the primary axial direction of directivity of the microphone unit 1 is parallel to the X direction which is the longitudinal direction of the microphone unit 1.

When the voice input device 5 is configured in this manner, the primary axial direction of directivity can be controlled by varying the value of the variable k in formula (2), and the voice of a close speaker can be acquired with high sensitivity by appropriately setting the value of the variable k, even if the installed position of the microphone unit 1 in the voice input device 5 is varied according to design convenience. When the voice input device is used, it is also possible to change the variable k and control the primary axial direction of directivity in accordance with the position of the close speaker, and to acquire the voice of the speaker with high sensitivity.

Figure 11:
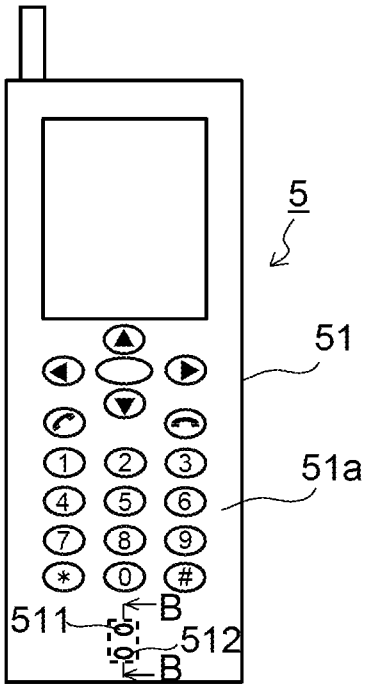
FIG. 11 A drawing showing the schematic configuration of an embodiment of a mobile telephone to which the microphone unit of the first embodiment is applied.
Figure 12:
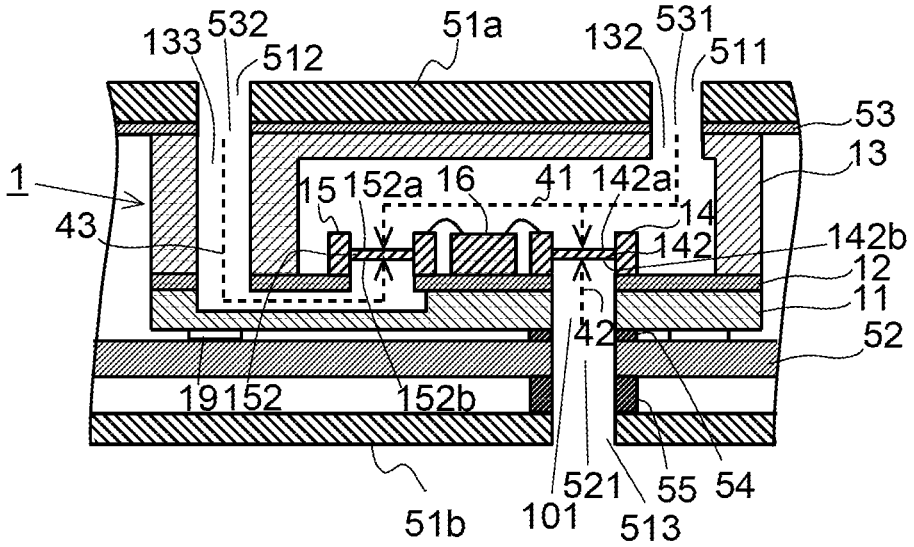
FIG. 12 A schematic cross-sectional view in position B-B of FIG. 11.

Herein is a description, made with reference to FIGS. 11 and 12, of a configurational example of a case in which the microphone unit is applied to a mobile phone (an example of a voice input device) comprising the function of a voice input device. FIG. 11 is a drawing showing the schematic configuration of an embodiment of a mobile telephone to which the microphone unit of the first embodiment is applied. FIG. 12 is a schematic cross-sectional view in position B-B of FIG. 11.

Two sound holes 511, 512 are provided in the bottom part side of a surface 51*a* of a housing 51 of the mobile telephone 5 as shown in FIGS. 11 and 12. One sound hole 513 is provided to a rear surface 51*b* of the housing 51 of the mobile telephone 5, as shown in FIG. 12. The user's voice is inputted via these three sound holes 511, 512, 513 to the microphone unit 1 which is disposed inside the housing 51.

The microphone unit 1 is installed in the mobile telephone 5 in a state of being mounted on a mounting substrate 52 provided inside the housing 51 of the mobile telephone 5, as shown in FIG. 12. The mounting substrate 52 is provided with the voice signal processor 6 described above (not shown in FIG. 12). The mounting substrate 52 is also provided with a plurality of electrode pads electrically connected with the plurality of external connecting electrodes 19 of the microphone unit 1, and the microphone unit 1 is mounted to the mounting substrate 52 using soldering or the like, for example. Thereby, a power source voltage is provided to the microphone unit 1, and electrical signals outputted from the microphone unit 1 are sent to the voice signal processor 6.

The microphone unit 1 is disposed so that the first sound hole 132 overlaps the sound hole 511 formed in the housing 51 of the mobile telephone 5, the second sound hole 101 overlaps the substrate through-hole 521 provided to the mounting substrate 52 and the sound hole 513 formed in the housing 51 of the mobile telephone 5, and the third sound hole 133 overlaps the sound hole 512 formed in the housing 51 of the mobile telephone 5.

Therefore, a voice occurring outside of the housing 51 of the mobile telephone 5 passes through the first sound path 41 of the microphone unit 1 to reach the top surface 142*a* of the first diaphragm 142 of the first MEMS chip 14, and passes through the second sound path 42 to reach the bottom surface 142*b* of the first diaphragm 142 of the first MEMS chip 14. The voice occurring outside of the housing 51 of the mobile telephone 5 also passes through the first sound path 41 of the microphone unit 1 to reach the top surface 152*a* of the second diaphragm 152 of the second MEMS chip 15, and passes through the third sound path 43 to reach the bottom surface 152*b* of the second diaphragm 152 of the second MEMS chip 15.

In the mobile telephone 5 of the present embodiment, an elastic body (a gasket) 53 is disposed between the housing 51 and the microphone unit 1. Openings 531, 532 are formed in the elastic body 53 so that voices occurring outside of the housing 51 are inputted independently and efficiently corresponding to the two sound paths 41, 43 provided to the microphone unit 1. The elastic body 53 is provided so as to ensure airtightness without any acoustic leaks. The material of the elastic body 53 is preferably butyl rubber, silicone rubber, or the like, for example.

For ensuring airtightness without any acoustic leaks, an airtight part 54 is also provided between the microphone unit 1 and the mounting substrate 52 so as to enclose the second sound hole 101 and the substrate through-hole 521 provided to the mounting substrate 52. This airtight part 54 is obtained by bonding together the airtightness terminal provided to the microphone unit 1 and the airtightness terminal provided to the mounting substrate 52 by soldering or the like, for example. Another precaution taken to ensure airtightness without any acoustic leaks is that an elastic body (a gasket) 55 is disposed between the mounting substrate 52 and the housing 51 so as to enclose the substrate through-hole 521 of the mounting substrate 52 and the sound hole 513 of the housing 51.

The present example is a configuration in which the microphone unit 1 is disposed in the bottom side of the mobile telephone 5 (stated with FIG. 11 in mind), but it is possible to control the primary axial direction of directivity of the microphone unit 1 functioning as a bidirectional microphone as described above. Therefore, the placement of the microphone unit 1 is not limited to the bottom side of the mobile telephone 5 and is easily varied.

(Summary and Remarks of First Embodiment)

As described above, the microphone unit 1 of the first embodiment comprises two bidirectional differential microphones having excellent distant noise suppression performance, and the primary axial directions of directivity of these two differential microphones are mutually different directions (offset by 90° in the present example, but not necessarily limited to 90°). The microphone unit 1 can be made to function as a single microphone by using the signals outputted from two differential microphones to perform a predetermined computation process, and the primary axial directions of directivity can be controlled by suitably varying the variables during the computation process. Consequently, the microphone unit 1 of the present embodiment is readily adapted to diversity in the design of a voice input device.

The microphone unit 1 of the first embodiment has a configuration in which the first sound path 41, the second sound path 42, and the third sound path 43 are formed by three members: the base 11, the microphone substrate 12, and the cover 13, and the configuration is easily assembled in a simple manner and is also easily made smaller and thinner.

In the above description, an example was presented of a case in which the microphone unit 1 is used as a close-talking microphone of a mobile telephone, but since the primary axial direction of directivity can be controlled, the microphone unit 1 is also readily applied to a device or the like for estimating sound sources, for example.

The first embodiment has a configuration in which a voice signal processor for controlling the primary axial direction of directivity is provided to the exterior of the microphone unit 1, but this signal processor may also be provided to the interior of the ASIC 16 of the microphone unit 1. In this case, it is possible to control the primary axial direction of directivity by inputting a control signal from the exterior to the microphone unit 1, the control signal being equivalent to a weighted coefficient (k in formula (2)) which is used for adding the two differential microphone outputs, and switching the mode of the computation process in the interior of the ASIC 16.

Second Embodiment

The following is a description of the second embodiment of the microphone unit and voice input device to which the present invention is applied.

(Microphone Unit of Second Embodiment)

A large portion of the configuration of the microphone unit of the second embodiment is identical to that of the microphone unit 1 of the first embodiment. Only the portion that is different is described hereinbelow. Portions duplicated from the microphone unit 1 of the first embodiment are described using the same symbols.

Figure 13:
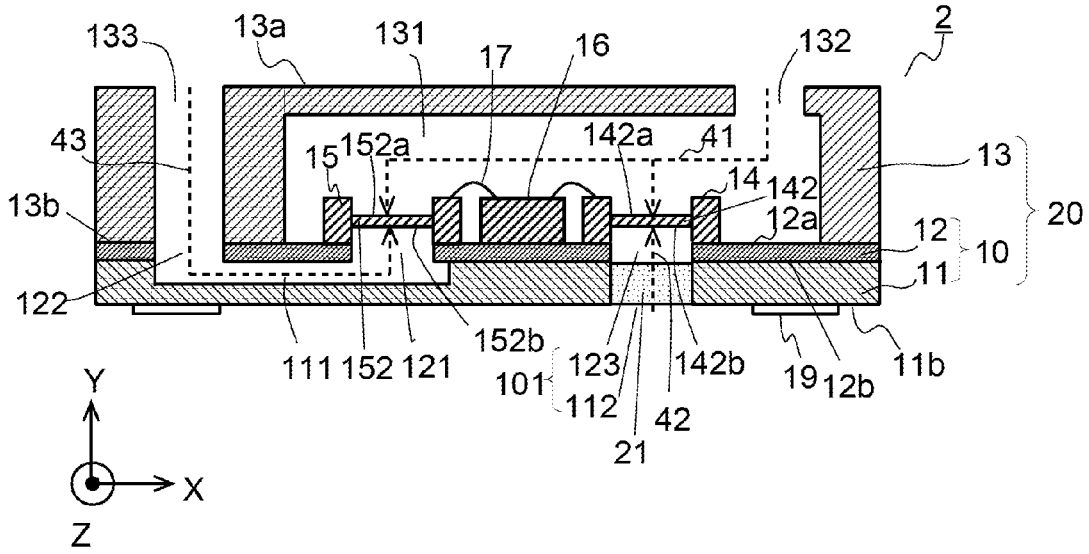
FIG. 13 A schematic cross-sectional view showing the configuration of the microphone unit of the second embodiment.

FIG. 13 is a schematic cross-sectional view showing the configuration of the microphone unit of the second embodiment. The microphone unit 2 of the second embodiment differs from the microphone unit 1 of the first embodiment in that an acoustic resistance member 21 is provided so as to block the second sound hole 101, as shown in FIG. 13. The acoustic resistance member 21 is formed from felt or the like, for example, and the phase of the acoustic waves inputted from the second sound hole 101 is delayed. In the microphone unit 2 of the second embodiment, the configuration of the acoustic resistance member 21 is adjusted so that the first MEMS chip 14 functions as a unidirectional microphone.

Figure 14:
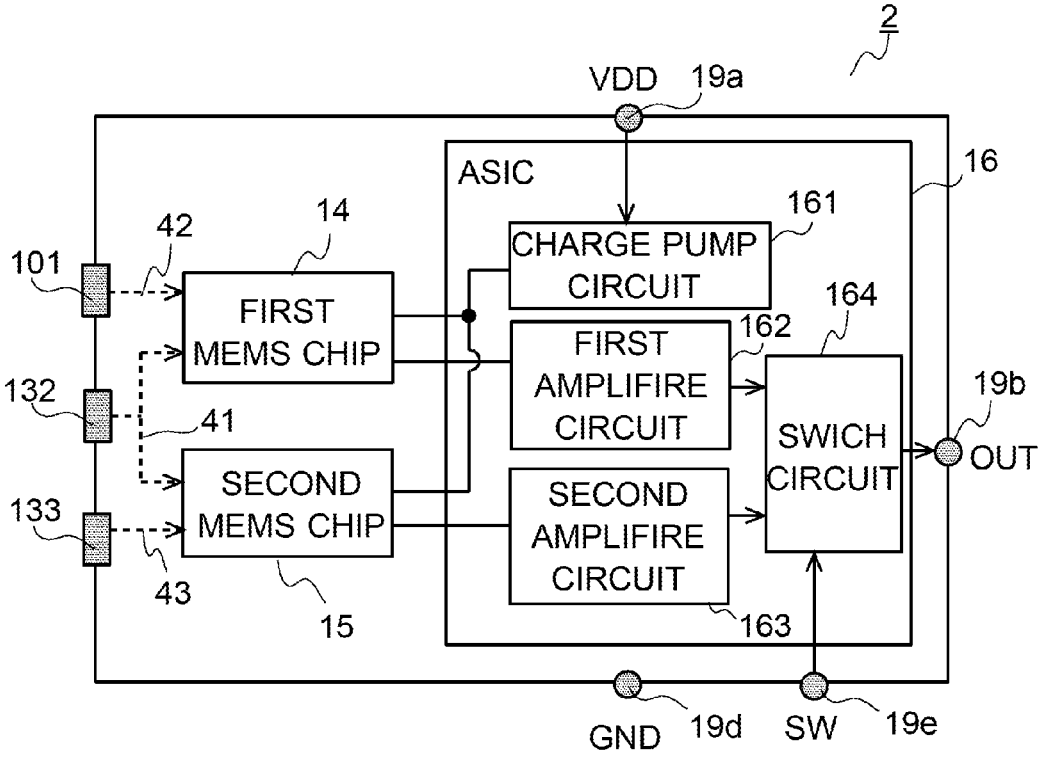
FIG. 14 A block diagram showing the configuration of the microphone unit of the second embodiment.

FIG. 14 is a block diagram showing the configuration of the microphone unit of the second embodiment. In the microphone unit 2 of the second embodiment, a switching electrode 19*e* is provided for inputting switch signals from the exterior (the voice input device in which the microphone unit 2 is mounted), and this microphone unit differs from the microphone unit 1 of the first embodiment in that a switch circuit 164 provided to the ASIC 16 is actuated by a switch signal sent via the switching electrode 19*e*, as shown in FIG. 14.

Figure 15:
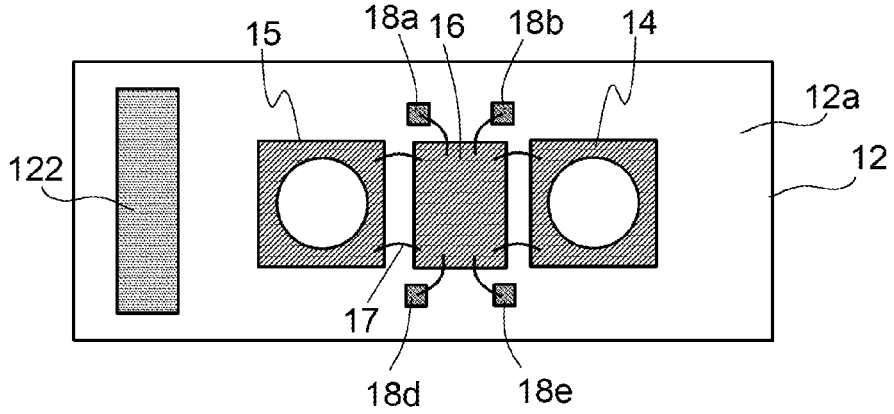
FIG. 15 A schematic plan view of the microphone substrate provided to the microphone unit of the second embodiment as seen from above.

Since the configuration is provided with the switching electrode 19*e*, a switching terminal 18*e* is provided to the top surface 12*a* of the microphone substrate 12, as shown in FIG. 15.

The switch circuit 164 is a circuit for switching between externally outputting the signal outputted from the first amplifier circuit 162, and externally outputting the signal outputted from the second amplifier circuit 163, as shown in FIG. 14. Specifically, in the microphone unit 2 of the second embodiment, the signal outputted from the microphone unit 2 is either only the signal extracted from the first MEMS chip 14 or only the signal extracted from the second MEMS chip 15.

Consequently, unlike the microphone unit 1 of the first embodiment, in the microphone unit 2 of the second embodiment, a single output electrode (the first output electrode 19*b*) is included in the external connecting electrodes 19 provided to the bottom surface 11*b* of the base 11. In connection with this, only the first output terminal 18*b* is provided to the top surface 12*a* of the microphone substrate 12 as shown in FIG. 15, and the second output terminal 18*c* is omitted (see also FIG. 3B).

The switching action of the switch circuit 164 according to the switch signal is preferably configured to use the signals H (high level) and L (low level), for example.

The operational effects of the microphone unit 2 of the second embodiment thus configured are described.

Figure 16A:
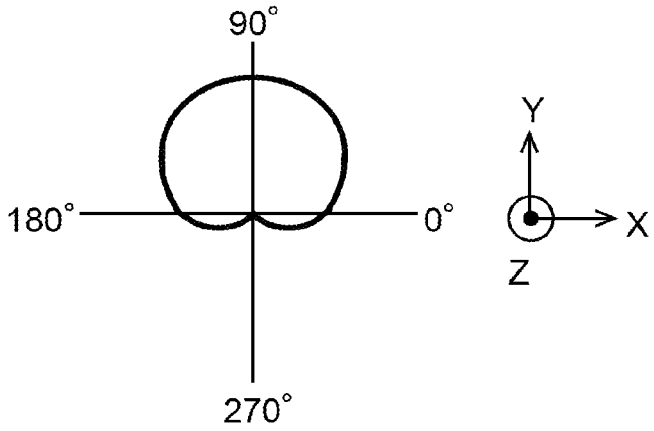
FIG. 16A A drawing for describing the directional characteristics of the microphone unit of the second embodiment.
Figure 16B:
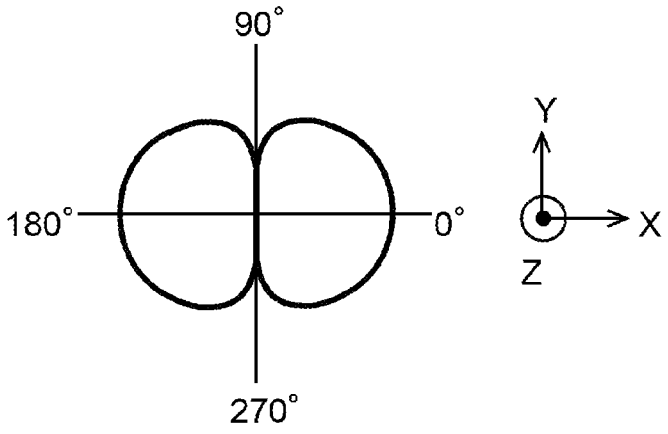
FIG. 16B A drawing for describing the directional characteristics of the microphone unit of the second embodiment.

FIGS. 16A and 16B are drawings for describing the directional characteristics of the microphone unit of the second embodiment. In FIGS. 16A and 16B, the orientation of the microphone unit 2 is assumed to be the same as the orientation shown in FIG. 13.

In the microphone unit 2 of the second embodiment, the first MEMS chip 14 functions as a differential microphone, but because of the presence of the acoustic resistance member 21, the microphone unit 2 also exhibits the function of a unidirectional microphone as shown in FIG. 16A. Specifically, the microphone unit 1 has good sensitivity with respect to sounds having a sound source to the side of one surface (the top surface side in FIG. 13), and extremely low sensitivity with respect to sounds having a sound source to the side of the other surface (the bottom surface side in FIG. 13). The second MEMS chip 15 configured as a differential microphone is not affected by the acoustic resistance member 21, and therefore exhibits the function of a bidirectional differential microphone having excellent distant noise suppression performance, similar to the microphone unit 1 of the first embodiment (see FIG. 16B). The primary axis of directivity of a bidirectional microphone using the second MEMS chip 15 is the longitudinal direction of the microphone unit 2 (the left-right direction of FIG. 13).

As described above, in the microphone unit 2 of the second embodiment, electrical signals extracted based on the changes in electrostatic capacitance of the first MEMS chip 14 and electrical signals extracted based on the changes in electrostatic capacitance of the second MEMS chip 15 can be selectively outputted by the switch circuit 164. Specifically, the microphone unit 2 can be used while switching between the function of a unidirectional microphone using the first MEMS chip 14 and the function of a bidirectional microphone using the second MEMS chip 15. Therefore, the microphone unit 2 of the second embodiment is readily adapted to the multifunctionality of the voice input device.

(Voice Input Device Comprising Microphone Unit of Second Embodiment)

The microphone unit of the second embodiment is applied to a mobile telephone, for example (one example of a voice input device). The configuration of the case of the microphone unit 2 of the second embodiment applied to a mobile telephone can be the same configuration as in the case of the first embodiment, for example (the same configuration as the one shown in FIGS. 11 and 12), and a detailed description thereof is omitted.

The mobile telephone to which the microphone unit 2 is applied is configured to be multifunctional; for example, the mobile telephone comprises a hands-free function and a video record function. A controller (not shown) of the mobile telephone, upon perceiving that any of the functions of a close-talking mode, a hands-free mode, and a video record mode is being used, inputs a corresponding switch signal to the microphone unit 2. According to this switch signal, the switch circuit 164 then performs a switching action so that either signals corresponding to the first MEMS chip 14 or signals corresponding to the second MEMS chip 15 can be outputted.

Specifically, when the mobile telephone is used in the close-talking mode, signals corresponding to the second MEMS chip 15 are outputted from the microphone unit 2 by the workings of the switch circuit 164, and the voice signal processor of the mobile telephone (whose workings are different from the voice signal processor 6 of the first embodiment) performs a process using the signals corresponding to the second MEMS chip 15. As described above, high-quality signals suited to close-talking are obtained in order to yield excellent distant noise suppression performance when the second MEMS chip 15 is used.

When the mobile telephone is used in the hands-free mode or the video record mode, due to the workings of the switch circuit 164, a signal corresponding to the first MEMS chip 14 is outputted from the microphone unit 2, and the voice signal processor of the mobile telephone performs processing using the signal corresponding to the first MEMS chip 14. As described above, when the first MEMS chip 14 is used, voice pickup focused on a voice in the intended pickup direction is possible, in order to yield excellent sensitivity in the surface side (the front surface side) where the first sound hole 132 and the third sound hole 133 are provided. Specifically, the preferred signal processing is performed in each mode.

(Summary and Remarks of Second Embodiment)

As described above, the microphone unit 2 of the second embodiment is configured comprising both the function of a bidirectional differential microphone having excellent distant noise suppression performance, and the function of a unidirectional microphone having excellent front-surface-side pickup sensitivity. Therefore, the microphone unit of the present embodiment is readily adapted to the multifunctionality of the voice input device in which the microphone unit is applied. Since the microphone unit 2 of the present embodiment comprises two functions, there is no need to separately install two microphone units as in conventional practice, and a size increase of the voice input device is readily suppressed.

The microphone unit 2 of the present embodiment is configured having the two MEMS chips 14, 15, and this configuration is obtained by adding a MEMS chip to the space originally provided with a bidirectional differential microphone having excellent distant noise suppression performance (the microphone unit previously developed by the inventors) and providing a sound hole (blocked by the acoustic resistance member 21) to the bottom side of the added MEMS chip. Therefore, there is no size increase in the microphone unit previously developed by the inventors. This is described below.

In the microphone unit 2 of the present embodiment, when the first MEMS chip 14, the second sound hole 101, and the acoustic resistance member 21 are taken out, a bidirectional differential microphone unit having excellent distant noise suppression performance is obtained. In this microphone unit, the distance between the centers of the two sound holes 132, 133 is preferably about 5 mm. This is due to the following reasons.

When the distance between the two sound holes 132, 133 is too small, the difference between sound pressures added to the top surface 152*a* and bottom surface 152*b* of the second diaphragm 152 is small, the amplitude of the second diaphragm 152 is small, and the electrical signals outputted from the ASIC 16 have a poor SNR. Therefore, it is preferable that the distance between the two sound holes 132, 133 be increased to a certain extent. On the other hand, when the distance between the centers of the two sound holes 132, 133 is too great, there is a large time difference, i.e., phase difference for acoustic waves produced from the sound source to pass through the two sound holes 132, 133 and reach the second diaphragm 152, and noise removal performance decreases. Therefore, the distance between the centers of the two sound holes 132, 133 is preferably 4 mm or greater and 6 mm or less, and more preferably about 5 mm.

The lengths of the MEMS chips 14, 15 (lengths in a direction parallel to a line joining the centers of the two sound holes 132, 133, lengths in the left-right direction in FIG. 13) used in the microphone unit 2 of the present embodiment are about 1 mm, for example, and the length of the ASIC 16 in the same direction is about 0.7 mm, for example. When the microphone unit is made to function as a differential microphone, it is preferably configured so that the time for acoustic waves to reach the top surface 152*a* of the second diaphragm 152 from the first sound hole 132 and the time for acoustic waves to reach the bottom surface 152*b* of the second diaphragm 152 from the third sound hole 133 are substantially the same. Therefore, the second MEMS chip 15 is disposed in the accommodating space (the space formed between the concave space 131 of the cover 13 and the top surface 12*a* of the microphone substrate 12) in a position separated from the first sound hole 132 (a position near the left of the accommodating space in FIG. 13).

Therefore, a space in which the first MEMS chip 14 can be disposed is originally present in the accommodating space of the bidirectional differential microphone unit having excellent distant noise suppression performance. Consequently, the microphone unit 2 of the present embodiment, wherein the function as a unidirectional microphone having excellent pickup sensitivity in the front surface side is added to the function as a bidirectional differential microphone having excellent distant noise suppression performance, can be made into a small microphone unit without the size being increased by the addition of a MEMS chip.

The present embodiment has a configuration in which the switch circuit 164 is provided after the amplifier circuits 162, 163, and signals corresponding to the first MEMS chip 14 and signals corresponding to the second MEMS chip 15 are switched and outputted. This is intended to make it possible to switch and output signals corresponding to the first MEMS chip 14 and signals corresponding to the second MEMS chip 15 to the exterior, but another configuration can be employed in achieving such an object. Specifically, the configuration may have one amplifier circuit, and a switch circuit for performing a switching action according to a switch signal may be disposed between the amplifier circuit and the two MEMS chips 14, 15, for example.

In cases in which two amplifier circuits 162, 163 are provided as in the present embodiment, the amplifier gains of the two amplifier circuits 162, 163 may be set to different gains.

The present embodiment has a configuration in which a shared bypass voltage is applied to the first MEMS chip 14 and the second MEMS chip 15, but the embodiment is not limited to such and may have another configuration. Specifically, the switch signal and the switch circuit may be used to switch which of the first MEMS chip 14 and the second MEMS chip 15 is electrically connected with the charge pump circuit 161, for example. This allows the possibility of crosstalk occurring between the first MEMS chip 14 and the second MEMS chip 15 to be reduced.

The microphone unit 2 of the present embodiment is configured so that either signals corresponding to the first MEMS chip 14 or signals corresponding to the second MEMS chip 15 are selectively outputted to the exterior. However, the microphone unit is not limited to this configuration. Specifically, similar to the case of the microphone unit 1 of the first embodiment (see FIG. 6), the microphone unit may be configured so that both signals are outputted separately and independently to the exterior (Modification A of the microphone unit 2 of the second embodiment). In this case, the configuration is preferably such that of the two signals, which signal will be used is selected in the voice input device comprising the microphone unit. As another aspect (Modification B of the microphone unit 2 of the second embodiment), the configuration shown in FIGS. 17 and 18 may be used.

Figure 17:
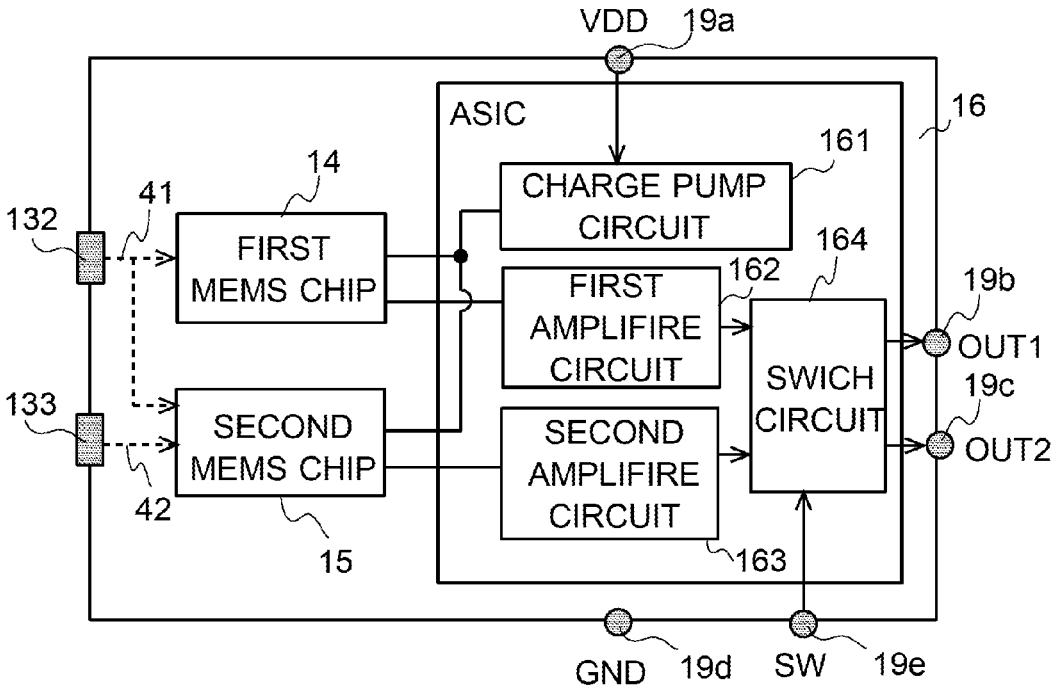
FIG. 17 A block diagram for describing a modification of the microphone unit of the second embodiment.
Figure 18:
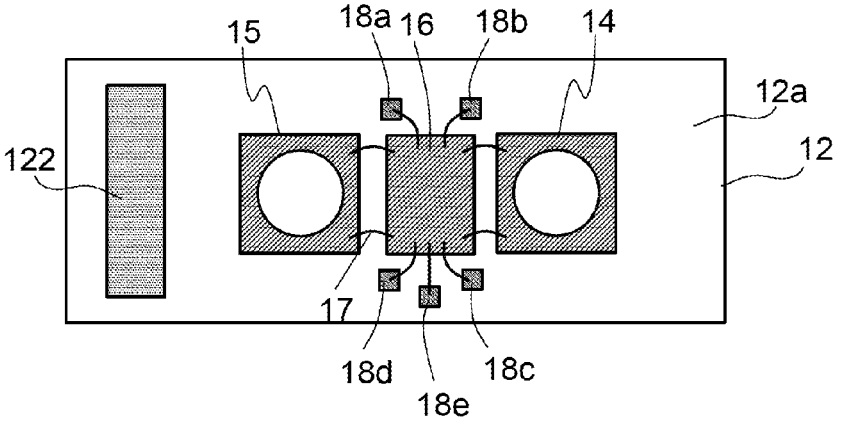
FIG. 18 A drawing for describing a modification of the microphone unit of the second embodiment; a schematic plan view of the microphone substrate as seen from above.

In the microphone unit of Modification B, a switching electrode 19*e* is provided for inputting switch signals from the exterior (the voice input device in which the microphone unit is mounted), and a switch circuit 164 provided to the ASIC 16 is actuated by a switch signal sent via the switching electrode 19*e*, as shown in FIG. 17. Because the switching electrode 19*e* is provided in this configuration, a switching terminal 18*e* is provided to the top surface 12*a* of the microphone substrate 12 as shown in FIG. 18.

The switch circuit 164 has a configuration for switching between which of the two output electrodes 19*b*, 19*c* (some of the external connecting electrodes 19) will output the signal outputted from the first amplifier circuit 162 and the signal outputted from the second amplifier circuit 163 (this function is different from the switch circuit of the microphone unit 2 of the second embodiment described above).

Specifically, when the switch circuit 164 is in a first mode according to the switch signal inputted from the switching electrode 19*e*, a signal corresponding to the first MEMS chip 14 is outputted from the first output electrode 19*b*, and a signal corresponding to the second MEMS chip 15 is outputted from the second output electrode 19*c*. When the switch circuit 164 is in a second mode according to the switch signal, a signal corresponding to the second MEMS chip 15 is outputted from the first output electrode 19*b*, and a signal corresponding to the first MEMS chip 14 is outputted from the second output electrode 19*c*.

The switching action of the switch circuit 164 according to the switch signal is preferably configured to use the signals H (high level) and L (low level), for example.

In cases in which the microphone unit and the voice input device are manufactured by different manufacturers, the following types of manufacturers are presumed to be among the manufacturers who manufacture the voice input device:

(A) Those who would prefer that between the signal corresponding to the first MEMS chip 14 and the signal corresponding to the second MEMS chip 15, which is outputted from the microphone unit be determined by switching according to the switch signal, as in the microphone unit 2 of the second embodiment and (B) Those who would prefer that both the signal corresponding to the first MEMS chip 14 and the signal corresponding to the second MEMS chip 15 are outputted separately and independently from the microphone unit, as in Modification A of the microphone unit 2 of the second embodiment.

Modification B of the microphone unit 2 of the second embodiment is advantageous in this respect because it can be adapted to both types of manufacturers in the above (A) and (B).

The second embodiment is also configured so that the signal corresponding to the first MEMS chip 14 and the signal corresponding to the second MEMS chip 15 are used independently. However, the embodiment is not limited to this configuration, and may be configured so that both signals are combined and subjected to the computation process (addition, subtraction, and so forth) by the voice signal processor. Performing such processing enables control for switching the directional characteristics of the microphone unit 2 among various types.

(Other)

The embodiments shown above are examples of the configuration to which the present invention is applied, and the applicable range of the present invention is not limited to the embodiments shown above. Specifically, various modifications may be made to the embodiments described above within a range that does not deviate from the objects of the present invention.

For example, in the embodiments shown above, the first vibrating part and second vibrating part of the present invention were configured as MEMS chips 14, 15 formed using semiconductor manufacturing techniques, but are not limited to such a configuration. For example, the first vibrating part and/or the second vibrating part may be a capacitor microphone or the like that uses an electret film.

In the embodiments described above, so-called capacitor type microphones were employed as the configurations of the first vibrating part and second vibrating part of the present invention. However, the present invention can also be applied to a microphone unit that employs a configuration other than that of a capacitor type microphone. For example, the present invention can also be applied to a microphone unit in which an electromotive (dynamic), electromagnetic (magnetic), piezoelectric, or other type of microphone or the like is employed.

In the above embodiments, the ASIC 16 (electrical circuit part) was configured as being included inside the microphone units 1, 2, but the electrical circuit parts may be disposed outside of the microphone units. In the embodiments shown above, the MEMS chips 14, 15 and the ASIC 16 are configured from separate chips, but the integrated circuit installed on the ASIC may be formed as a monolithic integrated circuit on the silicon substrate where the MEMS chips are formed.

In addition, the shape of the microphone unit is not limited to the shape of the present embodiment, and can of course be modified to various other shapes.

INDUSTRIAL APPLICABILITY

The microphone unit of the present invention can be applied to a variety of voice input devices which input voices and perform processing; for example, the microphone unit is suitable for a mobile telephone or the like.

LIST OF REFERENCE SIGNS

1, 2 Microphone unit
5 Mobile telephone (voice input device)
6 Voice signal processor
10 Installation part
11 Base (part of housing, part of installation part)
11*b* Bottom surface of base (rear surface of installation surface of installation part)
12 Microphone substrate (part of housing, part of installation part)
12*a* Top surface of microphone substrate (installation surface of installation part)
13 Cover
14 First MEMS chip (first vibrating part)
15 Second MEMS chip (second vibrating part)
16 ASIC (electrical circuit part)
19*e* Switching electrode
20 Housing
41 First sound path
42 Second sound path
43 Third sound path
101 Second sound hole
111 Groove part (configurational element of hollow space)
112 Base open part (configurational element of second sound hole)
121 First substrate open part
122 Second substrate open part
123 Third substrate open part (configurational element of second sound hole)
131 Concave space (configurational element of accommodating space)
132 First cover open part (first sound hole)
133 Second cover open part (third sound hole)
142 First diaphragm
142*a* Top surface (one surface) of first diaphragm

142*b* Bottom surface (other surface) of first diaphragm
152 Second diaphragm
152*a* Top surface (one surface) of second diaphragm
152*b* Bottom surface (other surface) of second diaphragm
164 Switch circuit

We claim:

1. A microphone unit comprising:

an installation part having a first diaphragm and a second diaphragm installed on a same installation surface; and a cover including an accommodating space in which the first and second diaphragms are housed, the cover being placed over the installation part, wherein a housing formed by the installation part and the cover is provided with:

a first sound path for transmitting sound pressure inputted from a first sound hole to one surface of the first diaphragm and to one surface of the second diaphragm;

a second sound path for transmitting sound pressure inputted from a second sound hole to the other surface of the first diaphragm; and a third sound path for transmitting sound pressure inputted from a third sound hole to the other surface of the second diaphragm;

the installation part has formed therein a first opening, a second opening, a hollow space in communication with the first opening and the second opening, and the second sound hole penetrating the installation part from the installation surface to a rear surface thereof; and the cover has formed therein the first sound hole, the third sound hole, and the accommodating space communicating with the first sound hole;

wherein:

the first diaphragm is disposed over the second sound hole;

the second diaphragm is disposed over the first opening;

the first sound path is formed using the first sound hole and the accommodating space;

the second sound path is formed using the second sound hole; and the third sound path is formed using the third sound hole, the second opening, the hollow space, and the first opening.

2. The microphone unit according to claim 1, wherein the first sound hole and the third sound hole are formed in the same surface of the housing, and the second sound hole is formed in a surface of the housing that is opposite to the surface in which the first sound hole and the third sound hole of the housing are formed.

3. The microphone unit according to claim 2, wherein the installation part comprises:

a base provided with a groove part and a base opening; and a microphone substrate stacked on the base and having the installation surface, the microphone substrate having formed therein the first opening, the second opening, and a third substrate opening which together with the base opening forms the second sound hole;

wherein the hollow space is formed using the groove part and the surface of the microphone substrate that opposes the base.

4. The microphone unit according to claim 1, further comprising an electrical circuit accommodated within the housing for processing electrical signals obtained by use of the first and second diaphragms.

5. The microphone unit according to claim 4, wherein the electrical circuit is disposed between the first and second diaphragms.

6. The microphone unit according to claim 4, wherein the electrical circuit separately outputs signals corresponding to the first diaphragm and signals corresponding to the second diaphragm.

7. A microphone unit comprising:

an installation part having a first diaphragm and a second diaphragm installed on a same installation surface; and a cover including an accommodating space in which the first and second diaphragms are housed, the cover being placed over the installation part, wherein a housing formed by the installation part and the cover is provided with:

a first sound path for transmitting sound pressure inputted from a first sound hole to one surface of the first diaphragm and to one surface of the second diaphragm;

a second sound path for transmitting sound pressure inputted from a second sound hole to the other surface of the first diaphragm; and a third sound path for transmitting sound pressure inputted from a third sound hole to the other surface of the second diaphragm;

the installation part has formed therein a first opening, a second opening, a hollow space in communication with the first opening and the second opening, and the second sound hole penetrating the installation part from the installation surface to a rear surface thereof; and the cover has formed therein the first sound hole, the third sound hole, and the accommodating space communicating with the first sound hole;

wherein:

the first diaphragm is disposed over the second sound hole;

the second diaphragm is disposed over the first opening;

the first sound path is formed using the first sound hole and the accommodating space;

the second sound path is formed using the second sound hole; and the third sound path is formed using the third sound hole, the second opening, the hollow space, and the first opening; and the microphone unit further comprises an acoustic resistance member disposed to block the second sound hole.

8. The microphone unit according to claim 7, wherein the first sound hole and the third sound hole are formed in the same surface of the housing, and the second sound hole is formed in a surface of the housing that is opposite to the surface in which the first sound hole and the third sound hole of the housing are formed.

9. The microphone unit according to claim 7, wherein the installation part comprises:

a base provided with a groove part and a base opening; and a microphone substrate stacked on the base and having the installation surface, the microphone substrate having formed therein the first opening, the second opening, and a third opening which together with the base opening forms the second sound hole;

wherein the hollow space is formed using the groove part and the surface of the microphone substrate that opposes the base.

10. The microphone unit according to claim 7, further comprising an electrical circuit accommodated within the housing for processing electrical signals obtained by use of the first and second diaphragms.

11. The microphone unit according to claim 10, wherein there is provided a switching electrode for inputting a switch signal from the exterior; and the electrical circuit includes a switch circuit for performing a switching action on the basis of the switch signal.

12. The microphone unit according to claim 11, wherein the switch circuit outputs either the signal corresponding to the first diaphragm or the signal corresponding to the second diaphragm.

13. The microphone unit according to claim 10, wherein the electrical circuit separately outputs a signal corresponding to the first diaphragm and a signal corresponding to the second diaphragm.

14. A voice input device comprising the microphone unit according to claim 1.

15. The voice input device according to claim 14, wherein:

the microphone unit separately outputs signals corresponding to the first diaphragm and signals corresponding to the second diaphragm; and the voice input device further comprises a voice signal processor for combining and processing the output signals from the microphone unit.

16. A voice input device comprising the microphone unit according to claim 7.

17. The voice input device according to claim 16, wherein:

the microphone unit separately outputs a signal corresponding to the first diaphragm and a signal corresponding to the second diaphragm, and the voice input device further comprises a voice signal processor for combining and performing computation processing on the signals outputted from the microphone unit.

* * * * *